US011992744B2

(12) United States Patent
Brasch et al.

(10) Patent No.: US 11,992,744 B2
(45) **Date of Patent: *May 28, 2024**

(54) FOLDING EXERCISE RACK SYSTEM

(71) Applicant: PRx Performance, LLC, Fargo, ND (US)

(72) Inventors: Brian B. Brasch, Fargo, ND (US); Brandon V. Anderson, Moorhead, MN (US)

(73) Assignee: PRx Performance, LLC, Fargo, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/182,891

(22) Filed: Mar. 13, 2023

(65) Prior Publication Data

US 2023/0218970 A1 Jul. 13, 2023

Related U.S. Application Data

(63) Continuation of application No. 17/207,968, filed on Mar. 22, 2021, now Pat. No. 11,607,599, which is a (Continued)

(51) Int. Cl.
*A63B 71/00* (2006.01)
*A63B 1/00* (2006.01)
(Continued)

(52) U.S. Cl.
CPC ..... *A63B 71/0036* (2013.01); *A63B 1/00* (2013.01); *A63B 21/078* (2013.01);
(Continued)

(58) Field of Classification Search
CPC ..... A63B 23/1218–1236; A63B 1/00; A63B 21/062–0632; A63B 21/068
See application file for complete search history.

(56) References Cited

U.S. PATENT DOCUMENTS 618,990 A 2/1899 Lubben
1,104,505 A 7/1914 Holworthy
(Continued)

FOREIGN PATENT DOCUMENTS

CN 103598759 A 2/2014
DE 4307632 A1 9/1993
(Continued)

OTHER PUBLICATIONS https://www.youtube.com/watch?v=f6bPYbS_2Fw; YouTube Video Equipment Demo Rogue Dirty South Bar, Apr. 25, 2012.
(Continued)

*Primary Examiner* — Nyca T Nguyen
(74) *Attorney, Agent, or Firm* — Neustel Law Offices

(57) ABSTRACT

A folding exercise rack system for providing an exercise rack that may be easily and compactly stored when not in use. The folding exercise rack generally includes a plurality of extension members pivotably connected to wall-connected mounting brackets. Upright support members connected to the extension members support a barbell and exercise bar. The exercise rack is pivotable from an extended exercise position into a plurality of selectable compact storage positions substantially parallel with and closely adjacent to the wall. The mounting brackets include a plurality of selectable connection points to determine how much space is present between the wall and exercise rack in the storage positions. One connection point allows a retractable exercise bench to be stored in the space between the wall and exercise rack. Mechanisms are provided for locking the exercise rack in a plurality of selected positions.

20 Claims, 24 Drawing Sheets

Related U.S. Application Data continuation of application No. 16/436,096, filed on Jun. 10, 2019, now Pat. No. 10,953,301.

(51) Int. Cl.
*A63B 21/078* (2006.01)
*A63B 23/035* (2006.01)
*A63B 23/12* (2006.01)

(52) U.S. Cl.
CPC .... *A63B 23/03525* (2013.01); *A63B 23/1218* (2013.01); *A63B 2210/50* (2013.01); *A63B 2225/093* (2013.01)

(56) References Cited

U.S. PATENT DOCUMENTS 1,286,151 A * 11/1918 Tothill ..... A63B 1/00 482/38
1,696,145 A 12/1928 Wagoner
2,855,200 A 10/1958 Blickman
3,414,262 A 12/1968 Lounsbury
3,614,097 A 10/1971 Blickman
3,874,657 A 4/1975 Niebojewski
3,918,710 A 11/1975 Niebojewski
4,249,726 A 2/1981 Faust
4,257,590 A 3/1981 Sullivan
4,262,901 A 4/1981 Faust
4,286,782 A 9/1981 Fuhrhop
4,306,715 A 12/1981 Sutherland
4,358,109 A 11/1982 Schrems
4,368,884 A 1/1983 Colvin
4,369,966 A 1/1983 Silberman
4,396,191 A 8/1983 Metler
4,527,797 A 7/1985 Slade, Jr.
4,603,855 A 8/1986 Sebelle
4,615,524 A 10/1986 Sutherland
4,621,809 A 11/1986 Pearl
4,635,934 A 1/1987 Roethke
4,637,608 A 1/1987 Owens
4,645,196 A 2/1987 Christie
4,650,186 A 3/1987 McCreery
4,729,561 A 3/1988 Desjardins
4,757,998 A 7/1988 Landin
4,759,539 A 7/1988 Nieppola
4,765,616 A 8/1988 Wolff
4,773,642 A 9/1988 Cruz
4,781,374 A 11/1988 Lederman
4,795,149 A 1/1989 Pearson
4,804,179 A 2/1989 Murphy
4,826,153 A 5/1989 Schalip
4,842,270 A 6/1989 Lange
4,844,448 A 7/1989 Niznik
4,861,024 A 8/1989 Lee
4,861,025 A 8/1989 Rockwell
4,898,381 A 2/1990 Gordon
4,907,798 A 3/1990 Burchatz
4,915,377 A 4/1990 Malnke
4,919,419 A 4/1990 Houston
4,927,135 A 5/1990 Nieppola
4,928,961 A 5/1990 Madden
4,934,693 A 6/1990 Santoro
4,936,572 A 6/1990 Desiderio
4,955,604 A 9/1990 Pogue
4,958,833 A 9/1990 Stater
4,960,277 A 10/1990 LaRossa
4,974,837 A 12/1990 Someya
4,976,428 A 12/1990 Ghazi
5,011,141 A 4/1991 Towley, III
5,046,722 A 9/1991 Antoon
5,082,259 A 1/1992 Gonzalez
5,082,260 A 1/1992 Dinelli
5,098,093 A 3/1992 Dupre
5,098,361 A 3/1992 Danylieko
5,141,480 A 8/1992 Lennox
5,151,072 A 9/1992 Cone
5,184,992 A 2/1993 Banks
5,242,345 A 9/1993 Mitchell
5,249,858 A 10/1993 Nusser
5,281,193 A 1/1994 Colbo, Jr.
5,306,220 A 4/1994 Kearney
5,328,428 A 7/1994 Huang
5,346,448 A 9/1994 Sollo
5,350,346 A 9/1994 Martinez
D358,623 S 5/1995 Macasieb
5,456,644 A 10/1995 Hecox
5,466,204 A 11/1995 Nearing
5,509,876 A 4/1996 Reyes
5,551,936 A 9/1996 Parisi
5,662,556 A * 9/1997 Gangloff ..... A63B 1/005 482/17
5,669,859 A 9/1997 Liggett
5,688,216 A 11/1997 Mauriello
D390,287 S 2/1998 Hsieh
5,755,823 A 5/1998 Cleary
5,779,601 A 7/1998 Ish, III
5,813,951 A 9/1998 Einsig
5,882,283 A 3/1999 Stevens
5,921,897 A 7/1999 Stevens
5,964,684 A 10/1999 Sokol
5,971,897 A 10/1999 Olson
6,027,433 A 2/2000 Flynn
6,073,624 A 6/2000 Laurent
6,248,048 B1 6/2001 Zuckerman
6,299,568 B1 10/2001 Prok
6,328,679 B1 12/2001 Croft
6,443,877 B1 9/2002 Hoecht
6,579,213 B1 6/2003 Webber
6,685,601 B1 2/2004 Knapp
7,070,546 B1 7/2006 Grasso
7,338,416 B2 3/2008 Smith
7,374,516 B2 5/2008 Lundquist
7,393,309 B2 7/2008 Webber
7,455,621 B1 11/2008 Anthony
7,488,277 B1 2/2009 Knapp
7,549,950 B1 6/2009 Lundquist
7,575,538 B1 8/2009 Clark
7,635,322 B2 12/2009 Parrilla
7,666,118 B1 2/2010 Anthony
7,699,756 B2 4/2010 Piane, Jr.
8,047,972 B1 1/2011 Dean
8,231,509 B2 7/2012 Lundquist
8,491,449 B2 7/2013 Rogers
8,506,459 B2 8/2013 Cassidy
8,517,900 B1 8/2013 Britt
8,651,293 B2 2/2014 Boyer
8,727,953 B2 5/2014 Drechsler
9,192,799 B2 11/2015 Alenaddaf
9,333,387 B2 5/2016 Hopperstad
9,409,048 B1 8/2016 Hopperstad
9,498,670 B1 11/2016 Hopperstad
9,675,510 B2 6/2017 Moerth-Cross
9,713,745 B2 7/2017 Rogers
2004/0092369 A1 5/2004 Slawinski
2008/0276551 A1 11/2008 Thomas
2009/0017997 A1 1/2009 Piggins
2009/0143203 A1 6/2009 Knapp
2009/0289535 A1 11/2009 Weber
2012/0289384 A1 11/2012 Staten
2013/0257242 A1 10/2013 Bunch
2014/0243174 A1 8/2014 Alenaddaf
2014/0339184 A1 11/2014 Couch
2015/0148197 A1 5/2015 Lentz
2015/0264823 A1 9/2015 Shirley
2015/0290488 A1 10/2015 Hopperstad
2016/0016033 A1 1/2016 Schrag
2017/0065844 A1 3/2017 Hopperstad
2017/0146282 A1 3/2017 Dodge
2017/0197109 A1 7/2017 Cole
2017/0239512 A1 8/2017 Brasch
2018/0178051 A1 6/2018 Shaw, Jr.
2018/0326250 A1 11/2018 Henniger
2019/0126088 A1 5/2019 Henniger

(56) References Cited

U.S. PATENT DOCUMENTS

| | | | |
|---|---|---|---|
| 2019/0240525 | A1 | 8/2019 | Leipheimer |
| 2020/0131825 | A1 | 4/2020 | Hirtsiefer |
| 2020/0197737 | A1 | 6/2020 | Kistner |

FOREIGN PATENT DOCUMENTS

| | | | |
|---|---|---|---|
| GB | 2076299 | A | 12/1981 |
| WO | 2009003280 | A1 | 1/2009 |

OTHER PUBLICATIONS https://www.roguefitness.com/rogue-r-3w-fold-back-wall-mount-rack; Rogue Fitness R-3W Fold Back Wall Mount Rack Website Page; Jan. 1, 2014.

2717 Equipment Facebook Posts—W-1 Pull Up and Rack; Nov. 8, 2012.

2717 Equipment Facebook Posts—Wall Mounted Pull Up and Squat Rack; Mar. 27, 2012.

https://www.youtube.com/watch?v=koAzH910474; YouTube Video Matt Chan Talks the Dirty South Bar; Dec. 20, 2012.

Pictures of PRX Performance Pull-Up Bar on Central Rig Display at Granite Games; Oct. 5, 2013.

http://board.crossfit.com/showthread.php?t=86058; Pictures from Website for Crossfit Message Board; Feb. 8, 2014.

http://board.crossfit.com/showthread.php?t=86058; Website for Crossfit Message Board; Feb. 8, 2014.

http://www.roguefitness.com/rogue-4-monster-lite-wall-mount, Webpage from Rogue Fitness Monster Lite Wall Mount; Jan. 1, 2014.

http://www.roguefitness.com:80/x-43m-multi-grip-crossmember.php; Rogue Fitness X-43 Multi-Grip Crossmember Website Page; Jan. 23, 2013.

http://www.roguefitness.com:80/w4-garage-gym.php; Rogue Fitness W-4 Garage Gym Website Page; Jan. 23, 2013.

http://www.roguefitness.com:80/rogue-sm-2-monster-squat-stand.php; Rogue Fitness SM-2 Monster Squat Stand Website Page; Jan. 27, 2013.

http://www.roguefitness.com:80/rogue-r-3-power-rack.php; Rogue Fitness R3 Power Rack Website Page; Jan. 11, 2013.

http://www.roguefitness.com:80/bodyweight-gymnastics/rpg-pullup-system.php; Rogue Fitness Pull Up & RPG Systems Website Page; Jan. 23, 2013.

http://www.roguefitness.com:80/dirty-south-bar.php; Rogue Fitness Dirty South Bar Website Page; Jan. 23, 2013.

* cited by examiner

FOLDING EXERCISE RACK SYSTEM

CROSS REFERENCE TO RELATED APPLICATIONS

The present application is a continuation of U.S. application Ser. No. 17/207,968 filed on Mar. 22, 2021 which issues as U.S. Pat. No. 11,607,599 on Mar. 21, 2023, which is a continuation of U.S. application Ser. No. 16/436,096 filed on Jun. 10, 2019 now issued as U.S. Pat. No. 10,953,301. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to exercise equipment and more specifically to an exercise rack system providing a folding exercise rack that may be easily and compactly stored when not in use.

Related Art

Any discussion of the related art throughout the specification should in no way be considered as an admission that such related art is widely known or forms part of common general knowledge in the field.

Conventional exercise racks for use in working out with a weighted barbell have been in use for years. Examples of conventional exercise racks include squat stands, squat racks, squat cages, power racks and rigs. Conventional exercise racks are used for various types of exercises such as, but not limited to, squatting, bench presses, pull-ups and the like. A conventional exercise rack is comprised of a base, four vertical supports extending upwardly from the base and an upper connecting structure attached to the upper portions of the vertical supports. The vertical supports include spaced apart openings for receiving various types of support brackets (e.g. J-cups) to receive a barbell at various heights. One or more pull-up bars may also be attached to upper portions of the exercise rack allowing the user to perform pull-up exercises on the exercise rack.

In some variations of conventional exercise racks the base comprises two spaced-apart elongated base pieces and two or four vertical supports extending upwardly perpendicularly from the base pieces. The base pieces can be connected to each other and/or to the vertical supports by one or more cross-support pieces.

One problem with conventional exercise racks is they require a significant amount of space to utilize. Another problem with conventional exercise racks is they are not capable of being compactly stored without disassembling them.

Because of the inherent problems with the related art, there is a need for a new and improved folding exercise rack system for providing an exercise rack that may be easily and compactly stored when not in use.

SUMMARY

An example embodiment is directed to a folding exercise rack system. The folding exercise rack system comprises upper and lower mounting plates and a plurality of mounting brackets attachable to a wall, a plurality of extension-members extending outwardly from and pivotably connected to the brackets, and a pair of upright support members connected to the extension-members. The exercise rack system is moveable between an extended exercise position and a retracted compact storage position by laterally pivoting the extension members and attached support members on the pivotable connections with the mounting brackets. In the extended exercise position, the extension members and attached support members extend outwardly from the wall. In the retracted storage position, the support members are laterally folded substantially parallel with and closely adjacent to the wall.

In one aspect of the example embodiment, the mounting brackets include a plurality of selectable pivotable mounting points for the extension-members. The mounting points are arranged to enable the extension-members and connected support members to be mounted with a selectable offset from the wall and to extend outwardly from the wall by a selectable distance.

In another aspect of the example embodiment, the mounting brackets include a locking mechanism comprising a plurality of locking points arranged to enable the extension-members and connected support members to be locked in a selected position, such as the extended exercise position or retracted storage position.

In yet another aspect of the example embodiment, an exercise bar extends laterally between the support members with at least one end of the bar being pivotably connected to one support member and the opposite end being removably connected to the other support member. The pivoting connection is oriented to enable the exercise bar to be rotated vertically into a compact retracted position for storage.

There has thus been outlined, rather broadly, some of the features of the folding exercise rack system in order that the detailed description thereof may be better understood, and in order that the present contribution to the art may be better appreciated. Additional features will be described hereinafter and will form the subject matter of the claims appended hereto. In this respect, before explaining at least one embodiment, it is to be understood that the folding exercise rack system is not limited in its application to the details of construction or to the arrangements of the components set forth in the following description or illustrated in the drawings. The folding exerciser rack system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
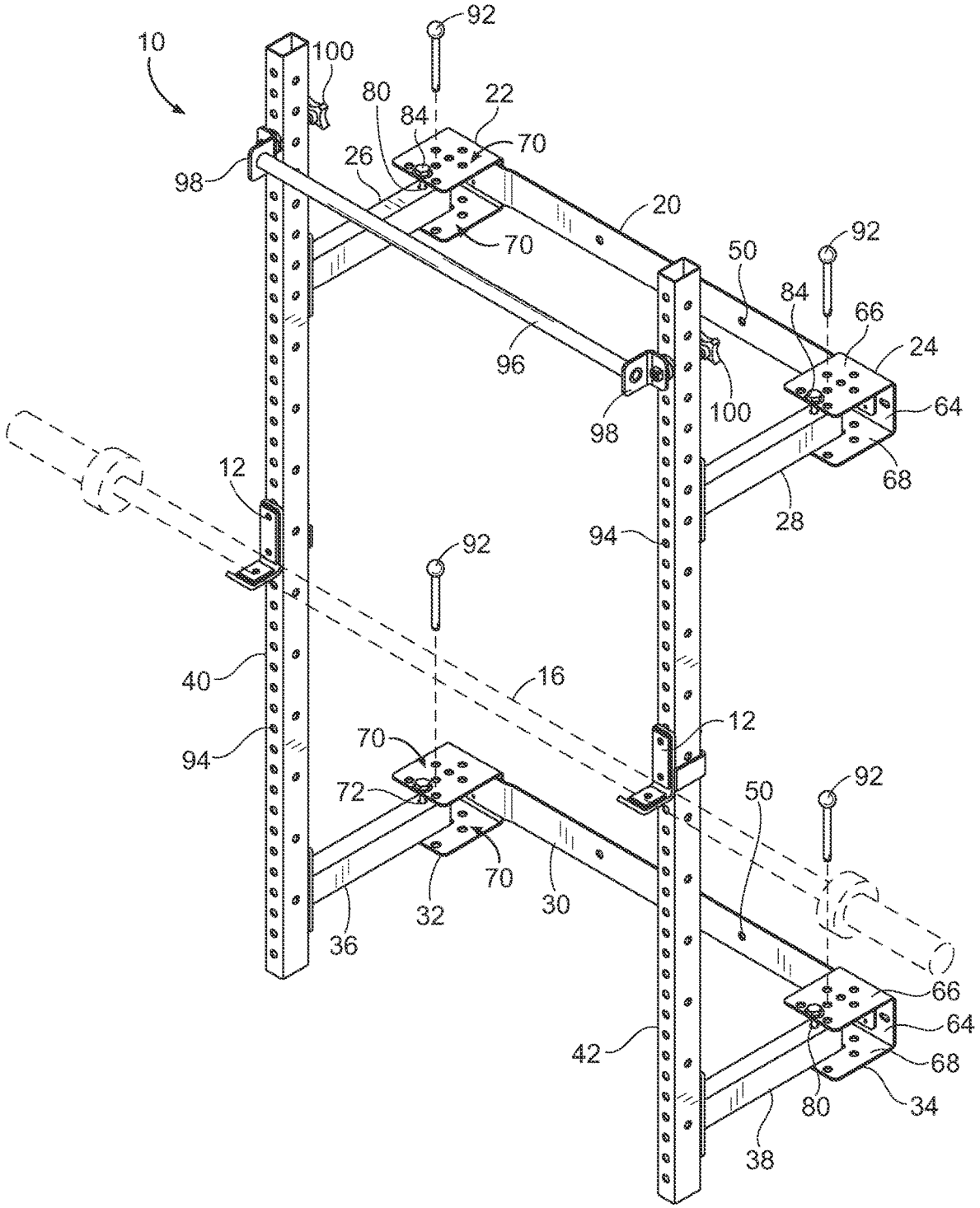
FIG. 1 is a front perspective view of a folding exercise rack in an extended exercise position in accordance with an example embodiment.

Turning now descriptively to the drawings, in which similar reference characters denote similar elements throughout the several views, FIGS. 1 through 21 illustrate example embodiments of a folding exercise rack system 10, which is movable between an extended position for use in exercising and a plurality of retracted compact storage positions substantially parallel with and closely adjacent to a wall or other substantially vertical mounting structure.

The folding exercise rack system 10 comprises an upper mounting plate 20 and a lower mounting plate 30 attachable to a wall 14, an upper pair of mounting brackets 22, 24 and a lower pair of mounting brackets 32, 34 attached to the upper and lower mounting plates, an upper pair of extension-members 26, 28 pivotably connected to the upper pair of mounting brackets, a lower pair of extension-members 36, 38 pivotably connected to the lower pair of mounting brackets, and a pair of upright support members 40, 42 connected to the extension-members. The folding exercise rack system may be attached to various building structures such as, but not limited to, the interior or exterior of a building structure, a garage, a gym, a bedroom and the like.

The pivotable connections between the extension-members and the mounting brackets have substantially vertical pivot axes enabling the extension members and connected upright support members to pivot laterally between the extended exercise position and the retracted compact storage position. Thus, as will be appreciated, the folding exercise rack can pivot or fold laterally inwardly and outwardly with respect to the wall 14 without any change in vertical position. One important feature and function of the folding exercise rack is the ability to move the extension members 26, 28, 36, 38 from an extended position where the connected support members 40, 42 are distally spaced away from the wall 14 (e.g., FIGS. 1, 10A, 17A) to facilitate exercise, to a plurality of different retracted positions that are substantially parallel with, and closely adjacent to the wall (e.g., FIGS. 3, 10B, 22) for compact storage of the exercise rack and related equipment. In an example embodiment, when the exercise rack is in the extended position, the support members 40, 42 may extend outwardly approximately 16-24 inches from the wall 14 to provide sufficient space for a user to perform various types of exercises (e.g. pull-ups, toes to bar, bench presses, etc.). When in the retracted position, the support members may extend outwardly from the wall about 0-12 inches thereby providing a compact storage structure and minimizing intrusion into the surrounding space and interference with other desired uses thereof.

Another important feature of the folding exercise rack 10 is the provision of a plurality of selectable pivotable connection points between the extension members 26, 28, 36, 38 and the corresponding mounting brackets 20, 22, 30, 32. Selectable openings 72, 74 in each of the mounting brackets and openings 80 in each of the extension members align to define a plurality of selectable pivotable connection points for the extension members at different distances extending outward from the wall. Selection of an opening 74 closer to the wall provides less extension of the support members 40, 42 outwardly from the wall in the extended exercise position, but minimizes the space between the wall and the exercise rack in the retracted storage position. Selection of an opening 72 further from the wall provides additional extension of the support members from the wall in the exercise position and additional space between the wall and the exercise rack in the retracted position for storage of a retractable exercise bench 60 and/or other items. Fixed and/or removable pins 84 extending vertically through the selected openings comprise pivot axes enabling the extension members and connected support members to pivot laterally inwardly and outwardly with respect to the wall 14 between the extended exercise and retracted compact storage positions.

Yet another important feature of the folding exercise rack 10 is the ability to lock the exercise rack in various selected positions including the extended exercise position and the plurality of retracted compact storage positions. Openings 86, 88, 90 in each of the mounting brackets and corresponding openings 82 in each of the extension members align as the extension members pivot laterally with respect to the mounting brackets to define a plurality of selectable locking positions for the exercise rack between the extended exercise and retracted storage positions. The selectable locking positions preferably include the extended exercise position and the retracted storage positions, and can also include intermediate positions. Removable pins extending through the aligned openings lock the folding rack in the selected position.

Yet another important feature of the folding exercise rack 10 is an exercise bar 96 that is moveable between an extended exercise position and a retracted storage position. In the exercise position, the bar extends laterally between the upright support members 40, 42 at a selectable height and may be used to perform various exercises including pull-ups, leg and knee raises, toes to bar, and many others. At least a first end of the bar has a pivotable connection with a first support member and a second end of the bar has a removable connection with a second support member. The pivotable connection comprises corresponding openings in a bracket on the first end of the bar and the first support and a loosenable twist pin 100 that extends through the openings. The removable connection comprises corresponding openings in a bracket on the second end of the bar and the second support and a removable twist pin 100 that extends through the openings. The axis of the pivotable connection is oriented substantially horizontally so that when the removable twist pin is removed and the loosenable twist pin is loosened, the disconnected second end of the bar is able to be rotated vertically downward about the pivoting first end of the bar into a retracted vertical position aligned with the first support for compact storage. The twist pin previously removed can be inserted through corresponding openings in the first support and the exercise bar to lock the bar in the retracted storage position.

B. Mounting Plates and Mounting Brackets

The folding exercise rack system 10 is pivotably attachable to a wall 14 or other substantially vertical support surface or structure with one or more mounting plates 20, 30 and mounting brackets 22, 24, 32, 34. In the example embodiments illustrated in FIGS. 1-21, mounting plate 20 comprises an upper mounting plate and mounting plate 30 comprises a lower mounting plate. Each mounting plate preferably comprises an elongated substantially flat bar or brace. The flat bar or brace is preferably constructed of a flat metal bar (e.g., a ⅜ inch thick steel flat bar). A substantially flat configuration is preferred to facilitate positioning the exercise rack as closely as possible to the wall when the exercise rack is in the retracted compact storage position as described further below.

The upper and lower mounting plates are attachable to the wall or other surface or structure to which the folding exercise rack is to be attached with the upper and lower mounting plates preferably extending laterally across the wall in substantially horizontal planes parallel with each other. The corresponding distal and proximal ends of the upper and lower mounting plates are also preferably vertically aligned.

In a preferred embodiment, the mounting plates 20, 30 are about 49 inches long or longer. This provides adequate distance between upright support members 40, 42 for exercising and to accommodate barbells of conventional length, as described further below. It also provides sufficient length to securely attach the folding exercise rack to multiple studs in a typical wall in which studs are typically spaced apart in 16-24 inch intervals.

Each of the mounting plates includes one or more apertures 50 or extended structures suitable to receive a fastener 52 (e.g. threaded fastener, lag bolt, lag screw, etc.) that extends into the wall 14 and preferably into a stud within the wall to securely retain the mounting plate against the wall. The apertures extending through the mounting plates may have various shapes such as circular, oval, slotted and the like. The apertures extending through the mounting plates are preferably spaced to align with the distance between conventional frame studs in a wall such as, but not limited to, 16 inch intervals and/or 24 inch intervals.

FIGS. 8A-8H and others illustrate the usage of threaded fasteners to secure the mounting plates 20, 30 to the studs in a wall 14. The use of three or four ½ inch lag screws of suitable length spaced laterally along the lengths of the mounting plates should be suitable to support weight loads of up to about 1000 pounds. Alternatively, if the folding exercise rack 10 is to be attached to a wall or other surface without standard stud spacing, stringer boards may be fastened to the studs and the mounting plates fastened to the wall through the stringer boards. In that case, the number and dimensions of the fasteners used may have to be adjusted depending on the weight to be supported.

The upper and lower mounting plates 20, 30 are preferably attached to the wall 14 at a height above a floor 18 or other substantially horizontal support surface or structure to accommodate the exercisers who are expected to use the folding exercise rack and the exercises to be performed. For example, the lower mounting plate will preferably be attached to the wall at a height less than about knee level for most exercisers or in a range of about 5.5-19.5 inches above floor level. However, the lower mounting plate could be attached even up to about 27.5 inches above floor level provided there is room to maintain about 50 inches of space between the upper and lower mounting plates. The upper mounting plate will preferably be mounted at a height approximately head level or in a range of about 63.5-83.5 inches. Preferably also, the vertical spacing between the lower and upper mounting plates will be at least about 50 inches to enhance the stability of the folding exercise rack during use. If the folding exercise rack system is to accommodate a wall-mounted retractable exercise bench 60 (FIGS. 17-20) as described below, the attachment height of the lower mounting plate should be selected to avoid interference with mounting the exercise bench.

Referring generally to FIGS. 1-6, 8-13, and 17-21, a mounting bracket 22, 24, 32, 34 is attached to each opposite end portion of each mounting plate 20, 30. The two mounting brackets 22, 24 attached to the end portions of the upper mounting plate 20 comprise the upper mounting brackets and the two mounting brackets 32, 34 attached to the end portions of the lower mounting plate 30 comprise the lower mounting brackets.

Figure 13A:
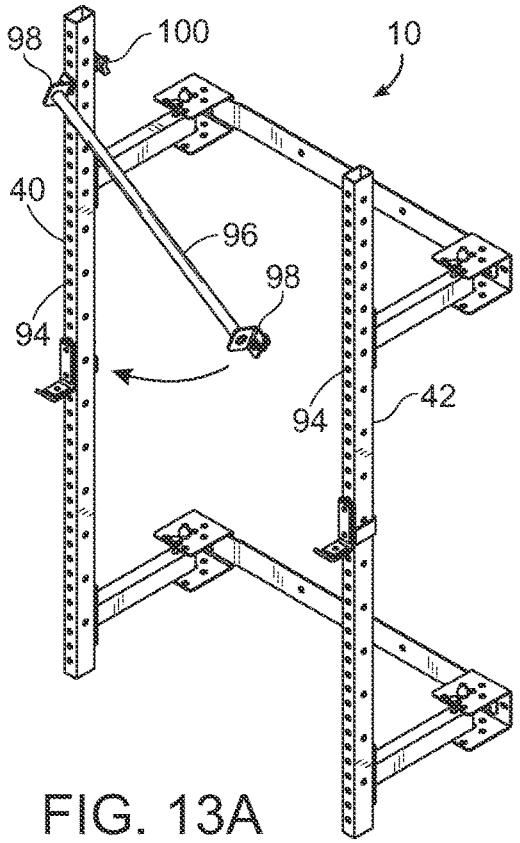
FIG. 13A is a front perspective view of a folding exercise rack with an exercise bar and a first end of the exercise bar being pivoted toward a storage position in accordance with an example embodiment.
Figure 13B:
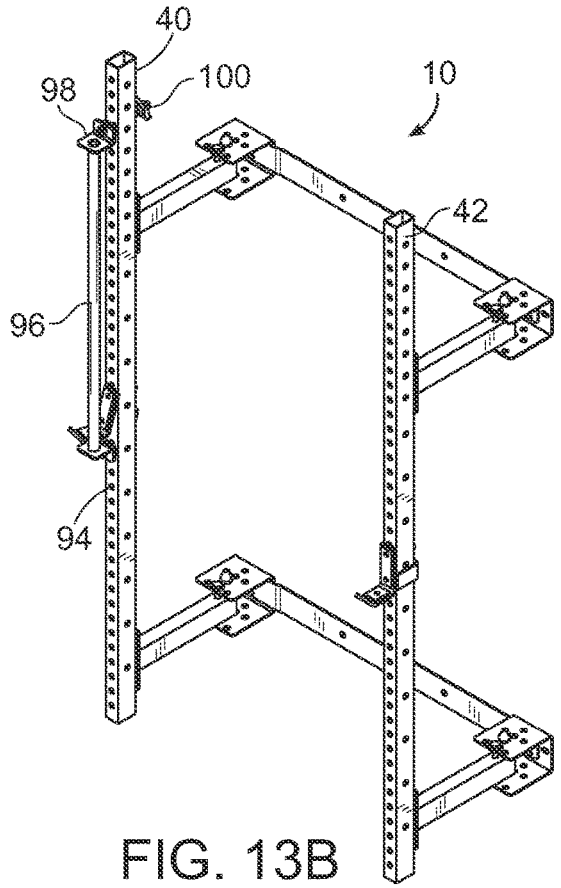
FIG. 13B is a front perspective view of a folding exercise rack with an exercise bar in a storage position in accordance with an example embodiment.
Figure 13C:
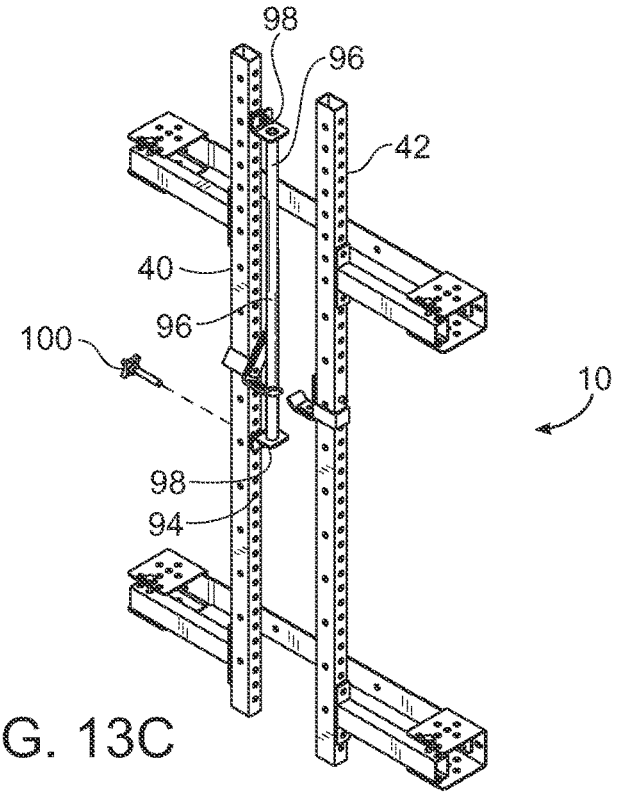
FIG. 13C is a front perspective view of a folding exercise rack with an exercise bar and twist pin for securing the exercise bar in a storage position in accordance with an example embodiment.
Figure 14:
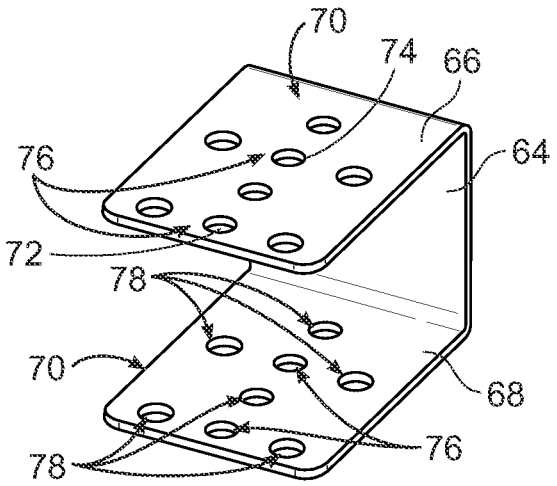
FIG. 14 is an enlarged perspective view of a mounting bracket of a folding exercise rack in accordance with an example embodiment.
Figure 15:
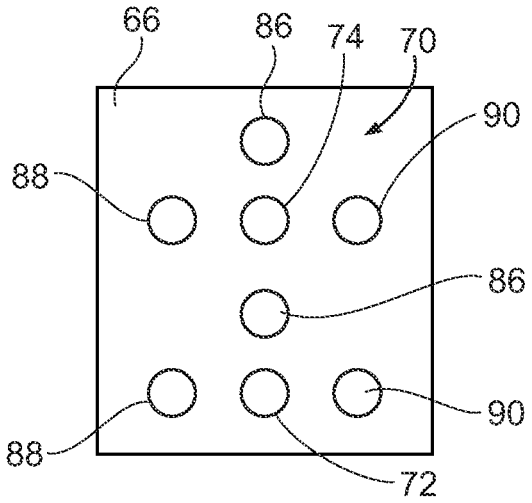
FIG. 15 is a top plan view of an upper portion of the mounting bracket of FIG. 14 illustrating first and second sets of apertures for pivoting and locking the folding exercise rack in accordance with an example embodiment.

Referring more specifically to FIGS. 14-15, each mounting bracket comprises a substantially C-shaped structure with a back portion 64, an upper portion 66, and a lower portion 68. The mounting brackets are preferably attached to the mounting plates 20, 30 before the mounting plates are attached to the wall 14 or other mounting surface. As illustrated in FIGS. 1-6, 9, 11-13, and 17-21, the mounting brackets are preferably attached to the backs of the mounting plates 20, 30 so that when the mounting plates are attached to the wall, the back portions 64 of the mounting brackets are secured to the wall between the mounting plates and the surface of the wall with the upper and lower portions 66, 68 of the brackets extending outwardly from the wall. The mounting brackets may be attached to the mounting plates in a conventional manner, for example by forming corresponding openings through the mounting plates and the back portions of the mounting brackets and using threaded fasteners such as tap screws and nuts. The back surfaces of the mounting plates may be slightly offset in the locations where the mounting brackets are attached in order to accommodate the thickness of the back portions of the mounting brackets and facilitate attaching the mounting plates and back portions of the mounting brackets substantially flush with the wall.

The mounting brackets are preferably constructed of a flat strong and rigid material, e.g., steel. The material is preferably thick enough to withstand bending, deformation, damage or breakage under the weights and stresses expected to be applied to the exercise rack during its intended use.

Figure 16:
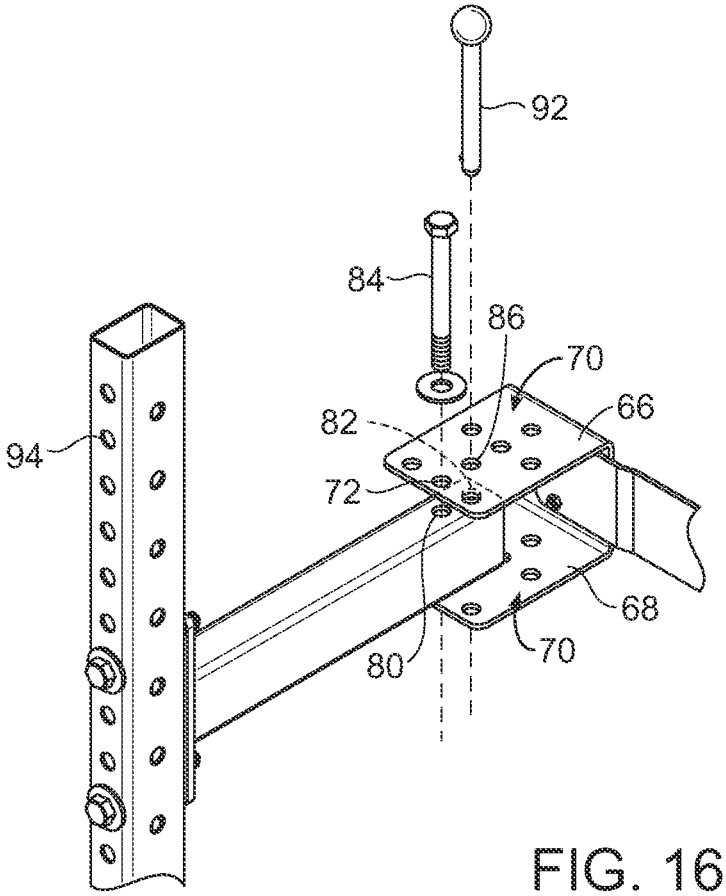
FIG. 16 is a partial perspective view of a support member, extension member, and mounting bracket of a folding exercise rack illustrating selectable pivoting and locking positions in accordance with an example embodiment.

As illustrated generally in FIGS. 1-4, 8, 9, 11-13, and 19, and in detail in FIGS. 14-16, a plurality of openings or apertures 70 extend through the upper and lower portions 66, 68 of each pivotable mounting bracket 22, 24, 32, 34. Preferably the pattern of openings through each upper portion is the same as the pattern through the corresponding lower portion and each opening of the upper portion is vertically aligned with a corresponding opening of the lower portion. The pattern includes a first set of openings 76 that provide a plurality of selectable pivotable connection points for extension members 26, 28, 36, 38 and a second set of openings 78 that provide for locking the exercise rack in selected positions between the extended exercise position and a plurality of retracted storage positions. The manner of pivotably connecting the extension members to the mounting brackets and locking the exercise rack in position is described further below in connection with a more detailed description of the extension members.

The provision of selectable pivotable connection points enables a user to mount the extension members a selected distance outward from the wall 14. This allows a user to adjust how far outward from the wall the connected support members 40, 42 will extend when the exercise rack 10 is in the extended exercise position and how close to the wall the exercise rack will be in the retracted storage position. When a connection point further from the wall is selected, additional space is created between the wall and the exercise rack when in the retracted storage position. This additional space can be used if desired to store other exercise equipment or items between the exercise rack and the wall as described further below. A plurality of selectable retracted compact storage positions are thus provided.

For this purpose, the first set of openings 76 preferably includes at least a first opening 72 and a second opening 74. The first and second openings are preferably positioned in alignment approximately along a center line of the upper and lower portions 66, 68 of each of the brackets 22, 24, 32, 34. The first opening is spaced a first distance from the back portion 64 of each bracket, and hence the wall, and the second opening is spaced a second lesser distance from the back surface and wall.

When the first opening 72 is selected, the extension member is pivotably connected to the mounting bracket spaced a first selected distance outward from the wall. Thus, the proximal end of the extension member will be positioned outwardly from the wall by a first selected distance and the distal end of the extension member and its connected support member 40, 42 will extend outwardly from the wall by a first selected distance when the exercise rack 10 is in the extended exercise position. See FIGS. 1-2, 7, 8A, 10A, 11, 16, and 17A. In the retracted storage position, the exercise rack also will be spaced outward from the wall by a first selected distance providing a first selected amount of space between the exercise rack and the wall. See FIGS. 3, 4, 8C, 8D, 9, 10B, 17C and 18-20.

Similarly when the second opening 74 is selected, the extension member is pivotably connected to the mounting bracket with its proximal end spaced a second selected distance outward from the wall. The distal end of the extension member and its connected support member will extend outwardly from the wall by a second selected distance in the extended exercise position. See FIG. 8E. In the retracted storage position, the exercise rack 10 will be spaced outward from the wall by a second selected distance and a second selected amount of space will be present between the wall and the exercise rack. See FIGS. 8G, 8H, 21.

In a preferred arrangement, the first and second openings 72, 74 are spaced apart so that selecting the first opening provides approximately three inches of additional extension in the exercise position and three inches of additional space between the wall and the exercise rack in the retracted storage position. When the first opening 72 is selected, the additional space in the extended exercise position can be used to accommodate a spotter for an exerciser using an exercise bench, such as the retractable bench 60 described below, to lift weights. See, e.g., FIG. 17A.

In the retracted storage position, the additional space between the wall and the exercise rack 10 can be used to store a retractable exercise bench 60 and/or other exercise equipment 62 or items as illustrated in FIGS. 17B, 17C and 18-20. For example, the retractable exercise bench 60 can be as described and claimed in U.S. Pat. No. 10,195,479, which is incorporated herein by reference. Such a bench is commercially available as the Profile® Folding Bench from PRx Performance of Fargo, North Dakota Other exercise equipment 62 may include items such as a Profile® AbMat, which is also commercially available from PRx Performance.

When the second opening 74 is selected, the upright support members 40, 42 extend outwardly from the wall a lesser distance when the exercise rack 10 is in the extended exercise position and less space is present between the wall and the exercise rack in the retracted storage position. However, when the second opening is selected, the exercise rack 10 retracts or folds into the storage position most closely adjacent to the wall and intrudes into the surrounding space the least. Compare FIGS. 8C and 8G, FIGS. 10B and 21.

It will be appreciated that the first set of openings 76 can include additional openings to provide additional selectable pivotable connection points at other distances from the wall. It also will be appreciated that additional openings could be provided offset from the center line of the mounting brackets 22, 24, 32, 34 to provide additional selectable pivotable connection points to space the extension members 26, 28 and 36, 38 nearer or farther apart without having to adjust the mounting bracket connections to the mounting plates 20, 30.

The second set of openings 78 preferably includes two groups of three openings 86, 88, and 90 with each group corresponding to one of the first and second openings 72, 74 of the first set of openings 76. In a preferred arrangement, the three openings of each group are positioned around and equidistantly-spaced from a corresponding first or second opening 72, 74. A first opening 86 is spaced inwardly toward the wall from the first or second opening 72, 74 in alignment with the first and second openings 72, 74. A second opening 88 is spaced laterally from the first or second opening 72, 74 respectively in the direction of the other corresponding upper or lower bracket at a right angle to the alignment axis of the first and second openings 72, 74 and substantially parallel to the back portion 64 of the bracket. A third opening 90 is spaced laterally from the first or second opening 72, 74 respectively in the opposite direction of the opening 88 and in lateral alignment therewith substantially parallel to the back portion 64 of the bracket.

The positions of the openings 86, 88, and 90 of the second set of openings relative to the first and second openings 72, 74 of the first set of openings provide three locking positions for the exercise rack. Opening 86 corresponds with a locking position in the extended exercise position. Opening 88 corresponds with a locking position in the retracted storage position in which the extension members 26, 28, 36, 38 and connected upright support members 40, 42 are folded inwardly toward each other and are substantially parallel with and closely adjacent to the wall 14. Opening 90 corresponds to another locking position in the retracted storage position in which the extension members and connected upright support members are folded outwardly away from each other and are substantially parallel with and closely adjacent to the wall.

It will be appreciated that the second set of openings can include additional openings located to enable the exercise rack 10 to be locked in other positions intermediate the extended exercise and plurality of retracted storage positions if desired. For example, another opening can be positioned between openings 86 and 90 so that as the extension members and connected support members pivot laterally inwardly from the fully extended exercise position toward the retracted storage position, they can be locked in an intermediate position. In this position, the upright members 40, 42 are spaced closer together than in the fully extended exercise position, which may be desirable or beneficial for certain desired exercises.

C. Pivotable Extension Members

In the example embodiments illustrated in FIGS. 1-21, an extension member 26, 28, 36, 38 is pivotably connected to each mounting bracket 22, 24, 32, 34 at an end portion of an upper or lower mounting plate 20, 30. Each extension member is thus indirectly pivotably connected to the wall 14 through a mounting bracket and a mounting plate. In a preferred arrangement, a first set or pair of upper extension members 26, 28 are pivotably connected to the upper mounting brackets 22, 24 and a second set or pair of lower extension members 36, 38 are pivotably connected to the lower mounting brackets 32, 34. The pivotable connections may be permanent or removable in nature.

Preferably, when the exercise rack 10 is in the extended exercise position, the upper extension members 26, 28 extend outwardly from the wall 14 in a first common substantially horizontal plane and the lower extension members 36, 38 extend outwardly from the wall in a second common substantially horizontal plane with the upper and lower extension members substantially vertically aligned. This ensures that the connected upright support members 40, 42 described further below are substantially vertical and parallel with each other and the wall.

Each extension member preferably comprises an elongated rectangular or square bar with a proximal end portion positioned nearer the wall and a distal end portion positioned further outward from the wall when the exercise rack 10 is in the extended position. Each bar is preferably dimensioned so that the proximal end portion can be inserted between the upper and lower portions 66, 68 of a mounting bracket 22, 24, 32, 34 without an excessive amount of play. Preferably the extension members are hollow, but can be solid if desired. The extension members are preferably constructed of a strong, rigid material, e.g., steel or another metal, sufficient to withstand bending, deformation, damage or other failure under the stresses and weights expected when the exercise rack is in use.

All of the extension members preferably have the same length. The length of the extension members (together with selection of the pivotable connection point on the bracket) determines the distance the connected upright support members 40, 42 will be positioned outwardly from the wall 14 when the exercise rack 10 is in the extended exercise position. Having extension members of the same length helps ensure that the upright support members 40, 42 will be a uniform distance from the wall 14 when the exercise rack is in the extended exercise position and will remain substantially vertical and parallel with each other and the wall in all positions of the exercise rack between the extended exercise position and the retracted compact storage position. However, it will be appreciated that if the upright support members when attached to the extension members are not substantially vertical, either because the wall itself is not substantially vertical or for other reasons, the lengths of individual extension members may be varied as desired or necessary to render the support members substantially vertical and parallel with respect to each other and the wall.

While the length of the extension members may be selected as desired to some extent, it will be appreciated that the selected length preferably should provide sufficient space between the support members 40, 42 and the wall 14 to perform desired exercises and to support weighted barbells without interference when the exercise rack 10 is in the extended position. Further, it is beneficial if the selected length provides sufficient space between the wall and the support members to accommodate a spotter if desired. At the same time, the selected length preferably should enable the exercise rack to be retracted and folded inwardly into the compact storage position substantially parallel with and closely adjacent to the wall without the upper and lower pairs of extension members 26, 28 and 36, 38, and the support members 40, 42 connected to each pair overlapping. In the example embodiments, the extension members can have a length of about 15 inches. However, with the foregoing in mind, for an embodiment in which the mounting plates 20, 30 are approximately 49 inches in length, the extension members could have a length in a range of about 20-24 inches without the upper and lower pairs of extension members and support members overlapping when folded inwardly in the compact storage position. However, if such overlap is not an issue, or if it is only desired to fold the extension members and support members outwardly when the exercise rack is in the compact storage position, then the extension members could have lengths up to about 30 inches or even longer.

As noted above, the proximal end portion of each extension member 26, 28, 36, 38 is pivotably connectable to a mounting bracket 22, 24, 32, 34. For that purpose, as best seen in FIGS. 1, 3, 9-12, and 16-18, a first opening or aperture 80 is formed in the proximal end and extends vertically through the extension member. When the proximal end is inserted in a mounting bracket between the upper and lower portions 66, 68, the first opening 80 is vertically aligned with a selected one of the first and second openings 72, 74 of the first set of openings 76 in the bracket.

A first bolt or removable pin 84 is inserted into and extends vertically through the aligned openings in the extension member and mounting bracket. The bolt or pin provides the pivotable connection between the extension member and bracket with a substantially vertical pivot axis. The pivotable connection can be made semi-permanent by using a threaded bolt, washers and a threaded nut, or can be made more readily removable or disconnectable by using a retractable pin, perhaps with a cotter pin to help hold it temporarily in place. Preferably, each extension member 26, 28, 36, 38 will be pivotably connected to a corresponding mounting bracket 22, 24, 32, 34 at the same pivotable connection point, i.e., the same opening 72 or 74, and in the same manner.

A second opening or aperture 82 is also formed in the proximal end of each extension member and extends vertically through the extension member as illustrated in FIGS. 8A-8H and 16. The second opening provides a mechanism to lock the exercise rack 10 in a selected position. The second opening 82 is preferably spaced apart from the first opening 80 and is aligned with the first opening along the central longitudinal axis of the extension member. The second opening 82 is spaced apart from the first opening 80 the same distance as each of the pivotable connection openings 72, 74 of the bracket is spaced apart from each of the corresponding locking openings 86, 88, and 90 of the bracket. In the example embodiment, the second opening 82 is positioned closer to the proximal end of the extension member than the first opening 80. The second opening preferably extends through the extension member in parallel with the first opening.

When the proximal end of an extension member is pivotably connected to a mounting bracket, the extension member can be pivoted to bring the second opening 82 into vertical alignment with a selectable one of the plurality of openings 86, 88, or 90 of the second set of openings on the bracket. The positions where the openings align define the positions in which the exercise rack 10 can be selectively locked. As described above, in the example embodiment, these positions correspond to a fully extended exercise position, a retracted storage position in which the extension members 26, 28 and 36, 38 and connected support members 40, 42 are folded inwardly toward each other, and a second retracted storage position in which the extension members and connected support members are folded outwardly away from each other. In both retracted positions, the extension members and support members are substantially parallel with and closely adjacent to the wall. See, e.g., FIGS. 3-4, 8C, 8D, 8G, 8H, 9, 10B, 17C and 18-21.

As illustrated in FIGS. 1-4, 7, 11-13, and 16-17, for example, a second bolt, or more preferably, a second removable pin 92 is inserted into and extends vertically through the aligned openings 82 in the extension member and 86, 88, or 90 in the mounting bracket. The bolt or pin locks the exercise rack 10 in the selected position. It is not necessary to lock all of the extension members to their corresponding mounting brackets to hold the exercise rack in position. Either an upper or lower extension member on each side of the exercise rack may be locked to hold the exercise rack in position. However, locking all of the extension members to their corresponding brackets provides a more secure lock and better stability. Further, while it is envisioned that both sides of the exercise rack will typically be locked in the same position, that is not necessarily the case and it is further envisioned that there may be situations when the opposite sides of the exercise rack will be locked in different positions. For example, it may be desirable in a given situation to lock one side of the exercise rack folded inwardly adjacent to the wall and the opposite side folded outwardly adjacent to the wall. The locking may be made more permanent by using a threaded bolt and nut, for example, and less permanent by using a removable push pin and cotter pin, for example. For ease of operation, the removable push pin is preferred.

The distal end portion of each extension member 26, 28, 36, 38 is adapted to connect an upright support member 40, 42 in a substantially vertical orientation. Although the connection can be made in a variety of suitable ways, in the example embodiment, a vertical flange is provided at the distal end of the extension member. Upper and lower spaced apart openings extend through the flange and align with corresponding openings 94 in a support member when a surface of the support member is brought into contact with the flange. The support member can be connected to the extension member through the flange using threaded bolts, washers, and threaded nuts or similar conventional fasteners.

D. Upright Support Members

The folding exercise rack system 10 includes a first upright support member 40 and a second upright support member 42, which may also be referred to as a left and a right support member respectively. The support members further provide adjustable supports 12 for a barbell 16, which may be used with the example embodiments, but does not comprise a component thereof. The support members also provide support for one or more pull-up bars 96 as further described below. The support members are each comprised of an elongated and preferably straight structure having a lower end and an upper end.

The first and second support members 40, 42 are distally spaced apart from each other when the exercise rack is in the extended exercise position to provide a suitable space for an exerciser to position the exerciser's body while performing exercises. In the example embodiments, the support members 40, 42 are preferably spaced apart laterally approximately 48 inches or less. The spacing between the support members is determined by the positioning of the mounting brackets 22, 24, 32, 34 on the mounting plates 20, 30 as described previously. In the example embodiments, as illustrated in FIGS. 1-21 and described above, the mounting plates have a length of approximately 49 inches, which accommodates the preferred approximately 48 inch or less spacing between the support members. However, it will be appreciated that by lengthening or shortening the mounting plates and adjusting the positions of the mounting brackets with respect thereto, spacing less than or greater than 48 inches and/or the length of the mounting plates can readily be achieved.

The support members 40, 42 preferably have the same length but may differ in length from one another. Preferably the length of the support members is in the range of 7.5-8 feet. This is sufficient to allow the exercise rack 10 both to support an exercise bar 96, such as a pull-up bar, described further below, and to be used as a squat rack. However, the support members may be shorter or longer depending on particular requirements. For example, in the alternative embodiment illustrated in FIG. 11, the length may be shortened to approximately 6 feet when the exercise rack is not intended to support a raised exercise bar but to be used as just a squat rack.

The support members are preferably constructed of square tubing (e.g. 2"×2", 3"×3", 4"×4") but may also be constructed of rectangular tubing (e.g. 2"×3", 3"×4"). While the support members are preferably tubular, they may be constructed of a solid material (e.g. a metal rod) or a shaped material (e.g. U-shaped cross section). It is preferred that the support members are tubular to provide necessary strength to support substantial weight and stress during use of the exercise rack while still providing a relatively lightweight structure to facilitate repositioning the exercise rack between extended exercise and retracted storage positions without undue effort. The support members are preferably constructed of a strong rigid material, e.g., steel or other metal, having sufficient strength to support a weighted barbell, such as barbell 16, having a total weight of up to about 1000 pounds. However, other materials and dimensions can be used as required to support other desired weight capacities. With the foregoing in mind, the support members may be constructed as a single contiguous structure or as multiple pieces interconnected by suitable means.

The support members 40, 42 are preferably substantially vertically oriented and parallel with respect to each other and with respect to the wall 14 as illustrated in FIGS. 1-13 and 17-21. Further, it is preferred that this relationship is maintained when the exercise rack 10 is in the extended exercise position, the retracted storage position, and as it transitions between those positions as illustrated throughout the drawings.

Preferably each support member 40, 42 is attached to the distal ends of a pair of upper and lower extension members 26, 36 and 28, 38 so that the lower ends of the support members just engage or are just above a floor 18 as illustrated in FIGS. 9-10, 18 and 20-21. Since, the support members will pivot laterally between the extended exercise and retracted storage positions, it may be preferable in some instances for the lower ends of the support members to be positioned just above the floor. This will help avoid contact with and possible damage to the floor during repositioning, and will accommodate a floor that is not substantially horizontal or that has an uneven surface. However, even when the lower ends of the support members are positioned in engagement with the floor, a small amount of play in the pivotable connection between the proximal ends of the extension members and the C-shaped mounting brackets 22, 24, 32, 34 should readily allow the uprights to be rotated between the extended and retracted positions without binding or damaging the floor.

Even when the support members 40, 42 are positioned with their lower ends just above the surface of the floor 18, weight on the support members when in use may cause the lower ends into engagement with the floor due to the small amount of play in the pivotable connection between the extension members and the mounting brackets. Thus, whether the lower ends of the support members are in engagement with the floor or just above it, as an additive measure to help avoid damage to the floor during use and repositioning of the exercise rack, the lower ends of the support members may be fitted with end caps if desired. The end cap material preferably will be softer than the support members. The end caps may also help reduce movement of the support members when the exercise rack is in use. Suitable materials include, but are not limited to, plastic or rubber.

Figure 17A:
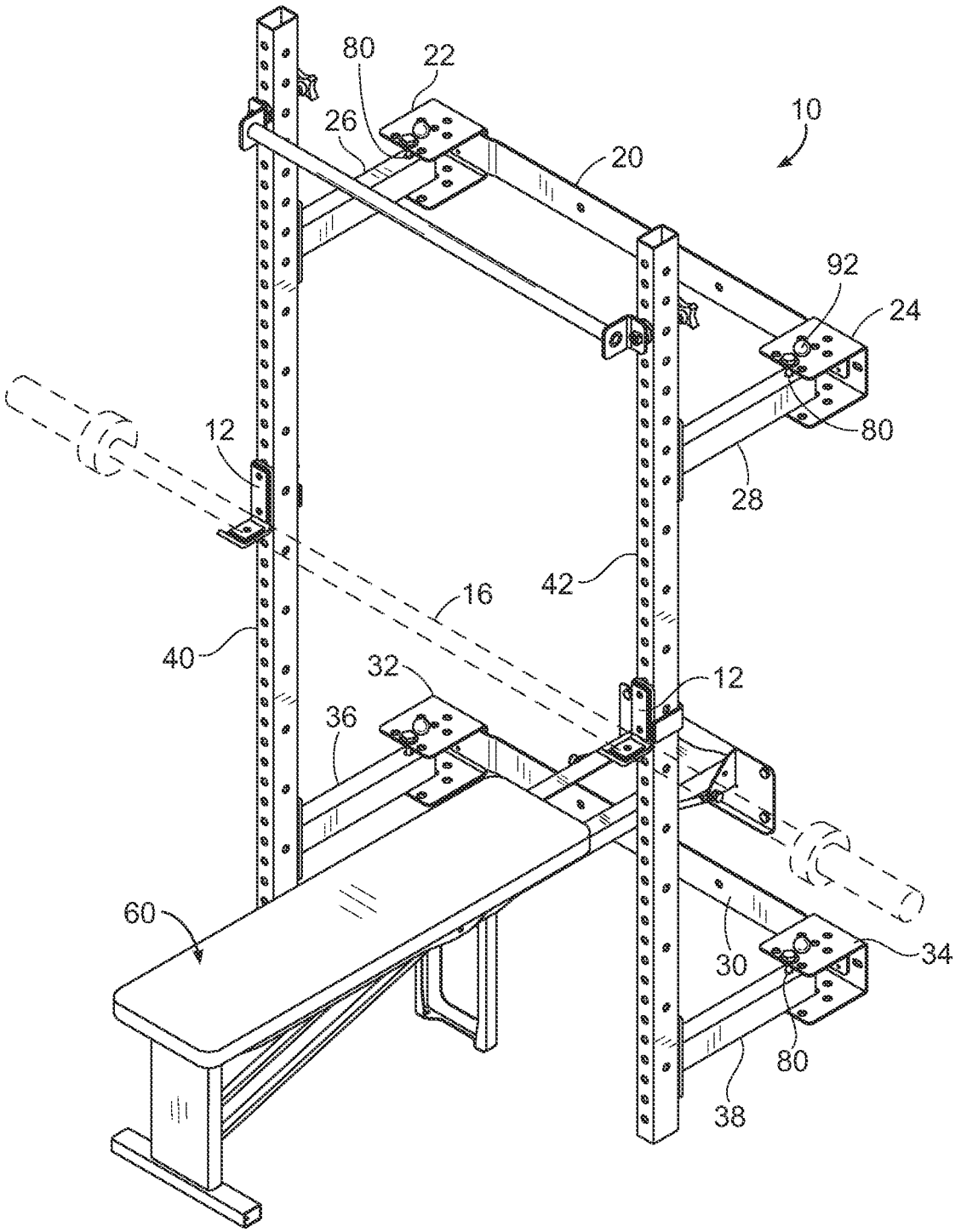
FIG. 17A is a front perspective view of a folding exercise rack and a retractable exercise bench in an extended exercise position with extension members pivotably connected to mounting brackets at a first pivotable connection point in accordance with an example embodiment.
Figure 17B:
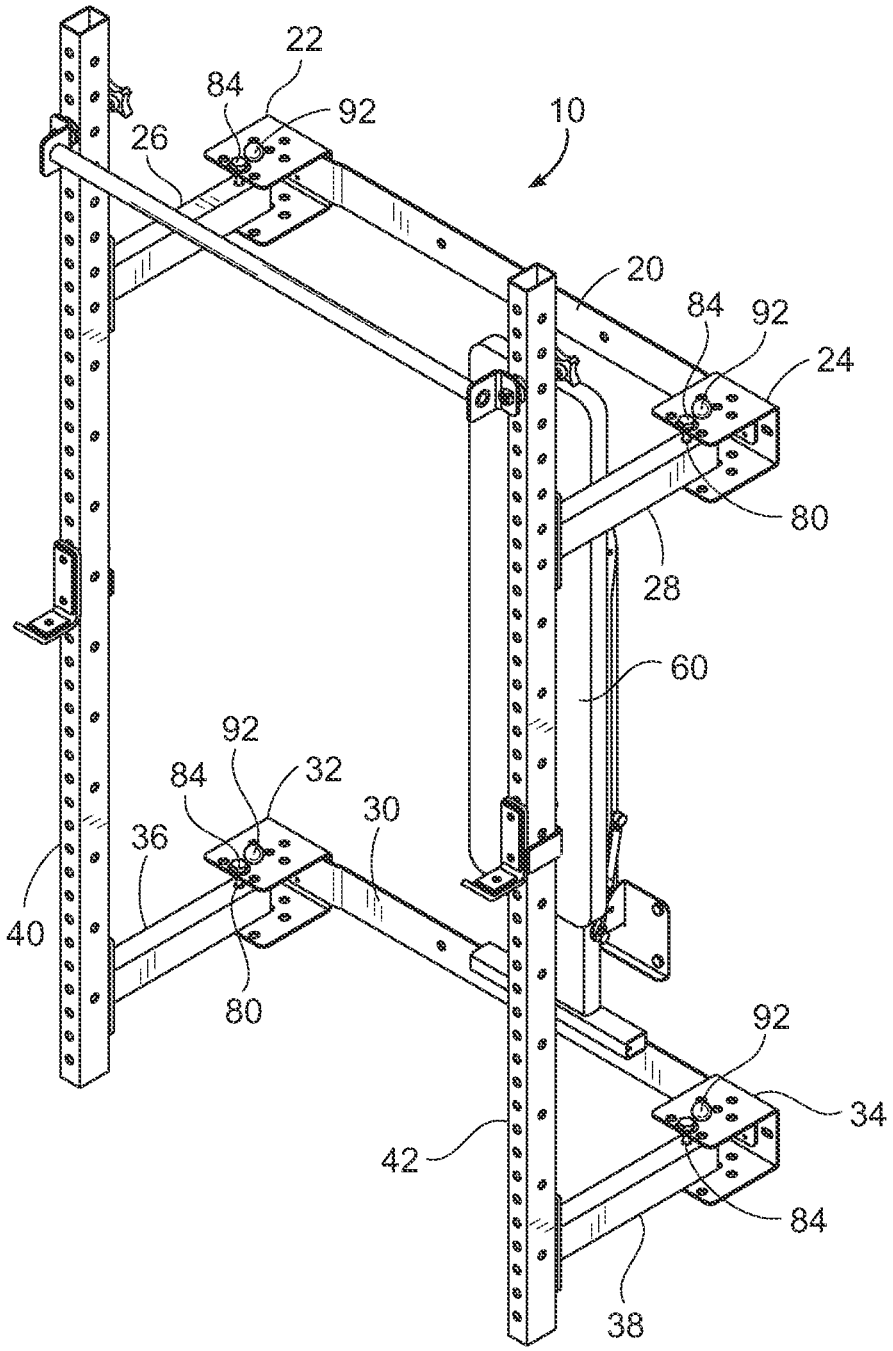
FIG. 17B is a front perspective view of a folding exercise rack in an extended exercise position with extension members pivotably connected to mounting brackets at a first pivotable connection point and with a retractable exercise bench in a retracted storage position in accordance with an example embodiment.
Figure 17C:
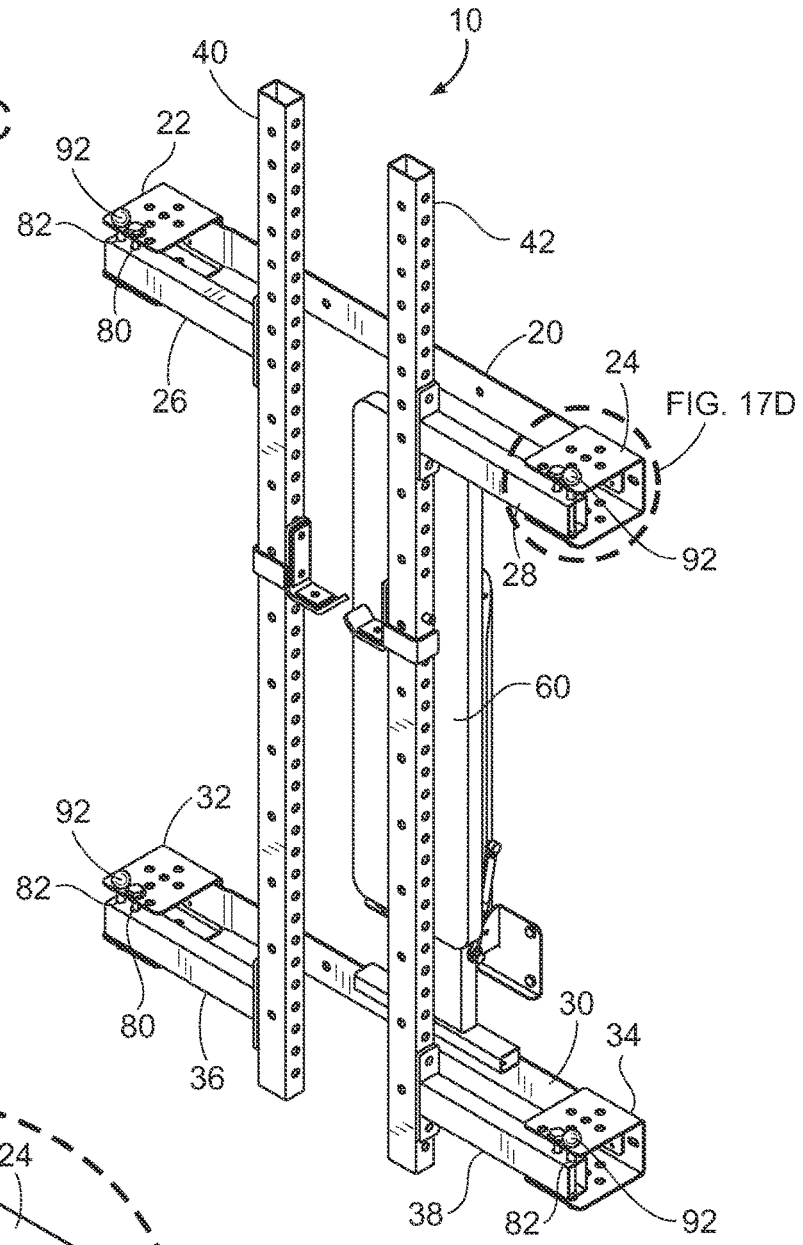
FIG. 17C is a front perspective view of a folding exercise rack and a retractable exercise bench in a first retracted compact storage position with extension members pivotably connected to mounting brackets at a first pivotable connection point in accordance with an example embodiment.
Figure 17D:
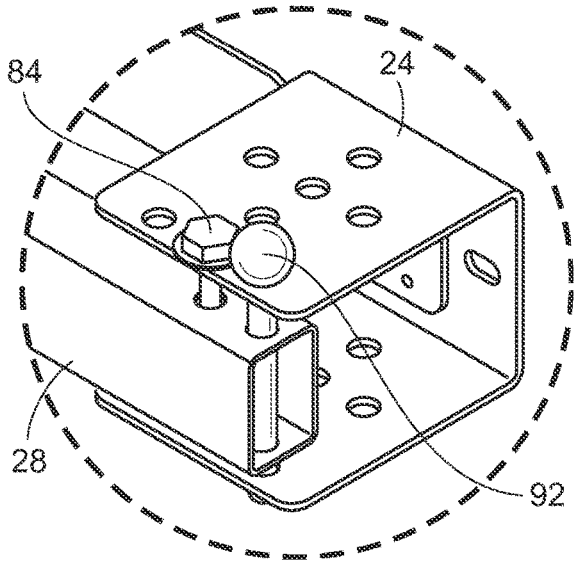
FIG. 17D is an enlarged partial view of one of the extension members and mounting brackets shown in FIG. 17C illustrating a pivot pin and locking pin extending though selectable pivot and locking openings of the bracket and extension member.
Figure 18:
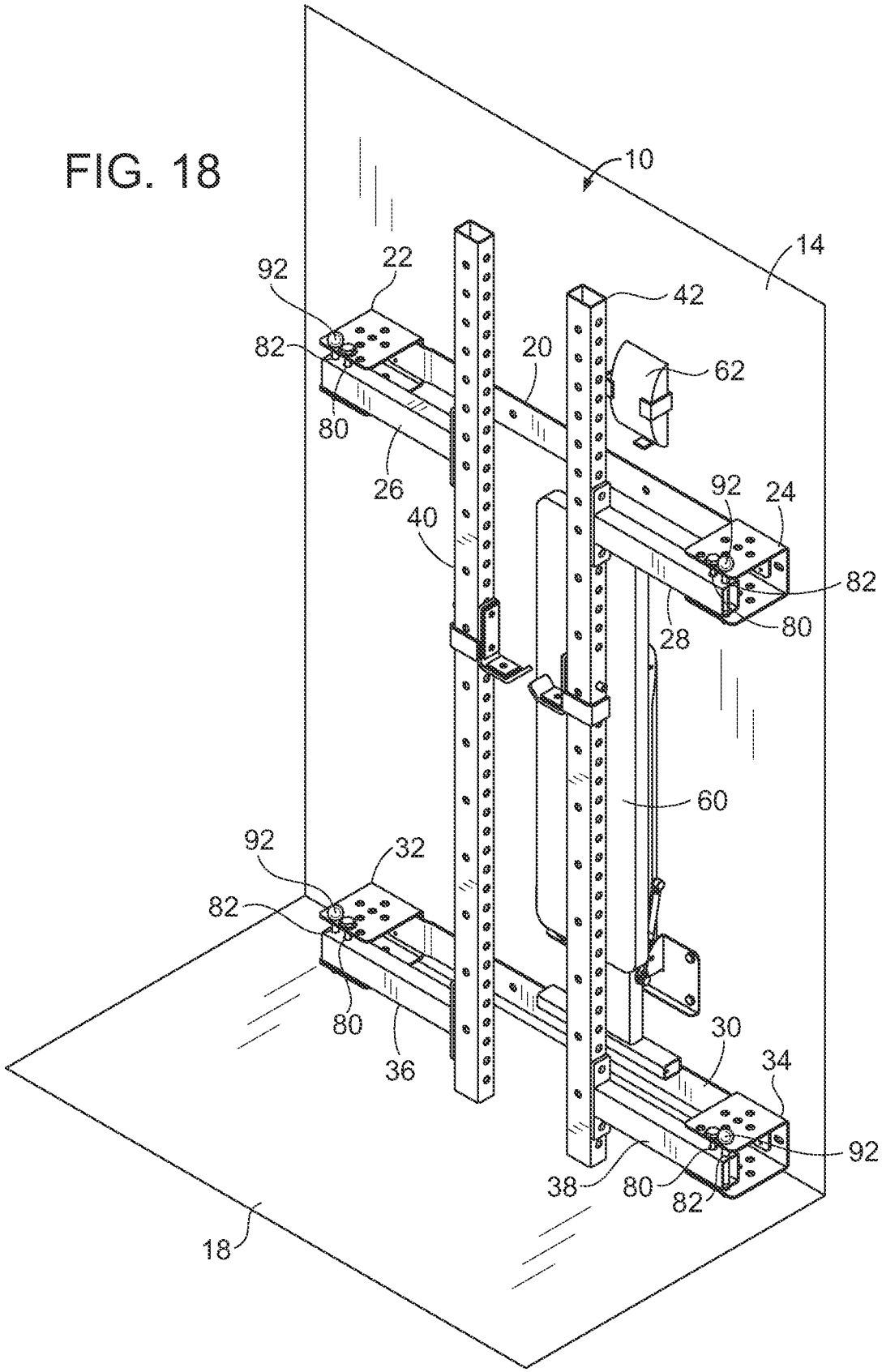
FIG. 18 is a front perspective view of a folding exercise rack and retractable exercise bench attached to a wall in a first retracted compact storage position with extension members pivotably connected to mounting brackets at a first pivotable connection point in accordance with an example embodiment.
Figure 19:
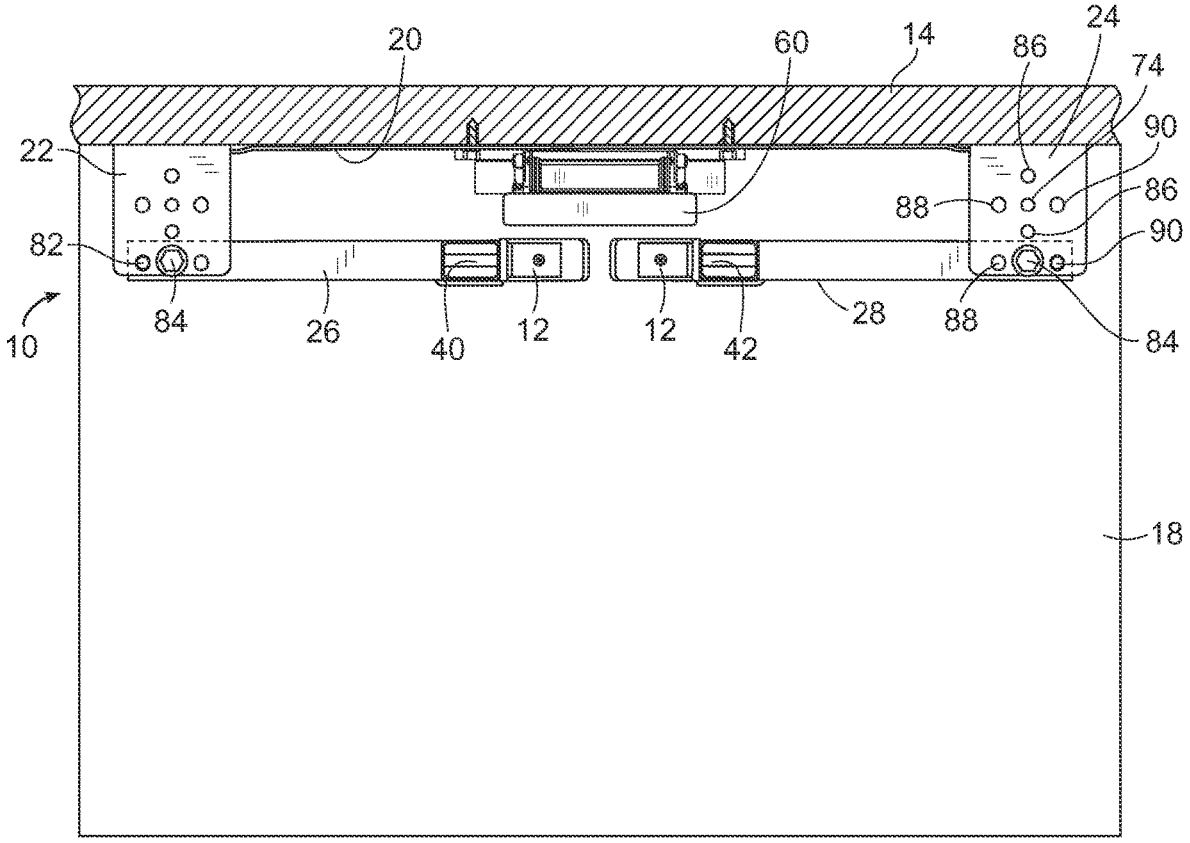
FIG. 19 a top view of a folding exercise rack and retractable exercise bench attached to a wall in a first retracted compact storage position with extension members pivotably connected to mounting brackets at a first pivotable connection point in accordance with an example embodiment.
Figure 20:
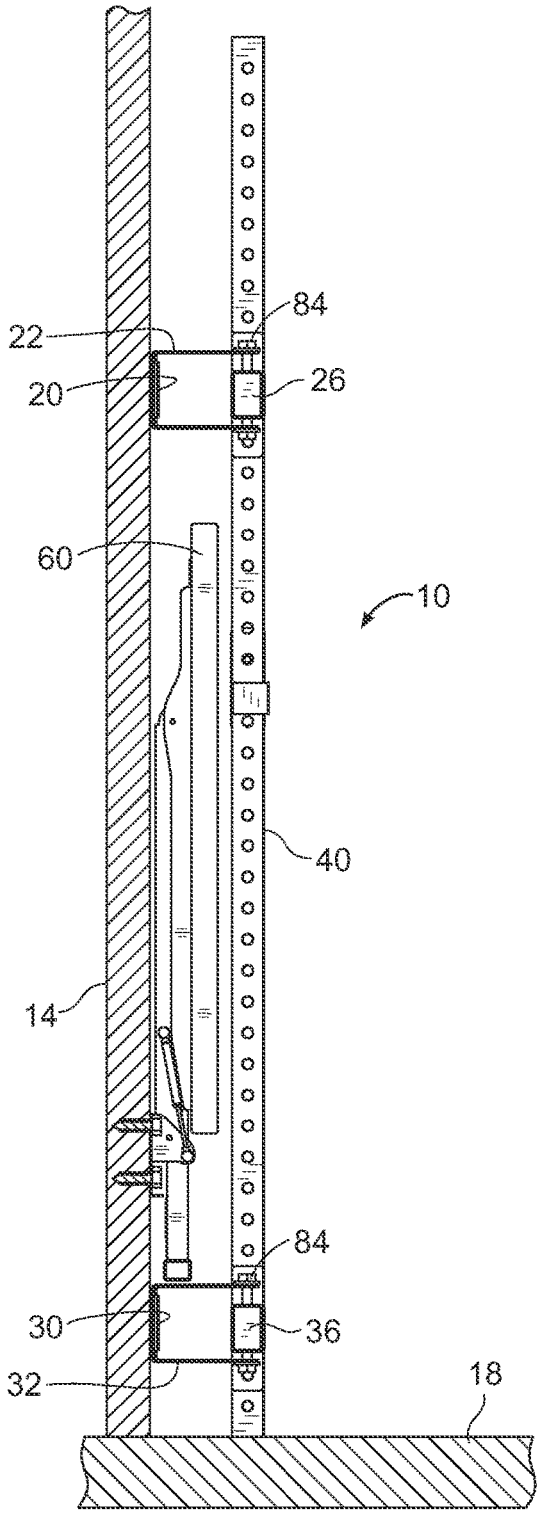
FIG. 20 is a side view of a folding exercise rack and retractable exercise bench attached to a wall in a first retracted compact storage position with extension members pivotably connected to mounting brackets at a first pivotable connection point in accordance with an example embodiment.
Figure 21:
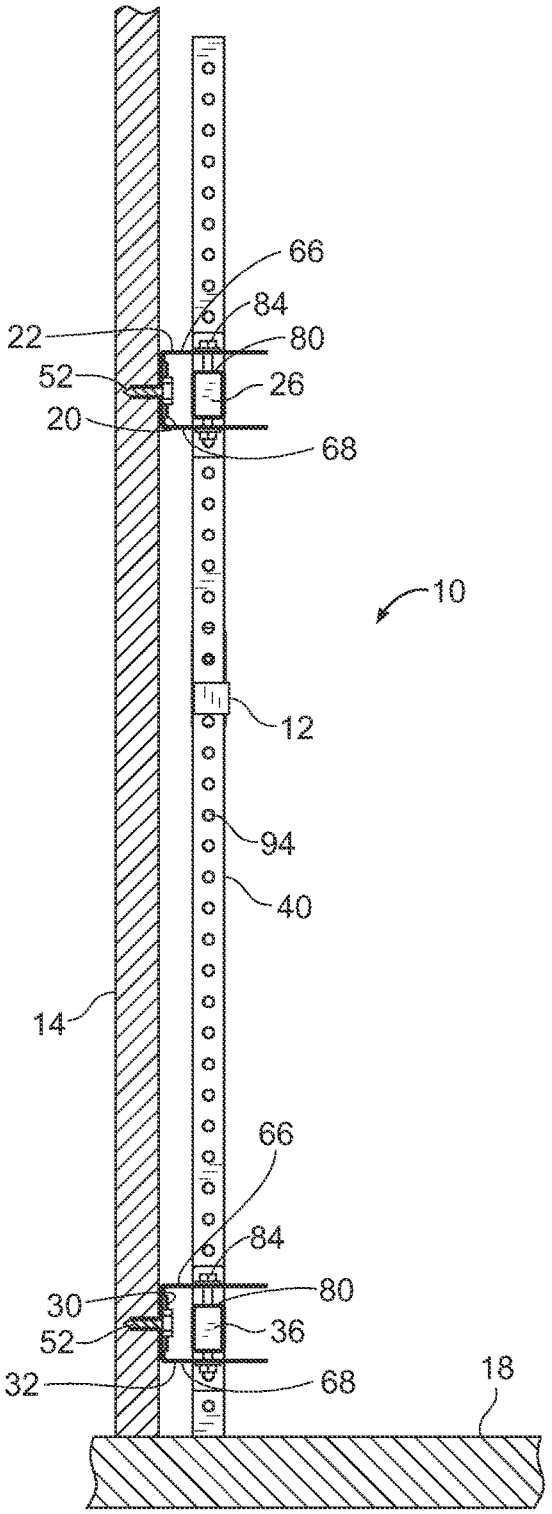
FIG. 21 is a side view of a folding exercise rack attached to a wall in a second retracted compact storage position with extension members pivotably connected to mounting brackets at a second pivotable connection point in accordance with an example embodiment.

The first support member 40 and the second support member 42 each include a plurality of openings or apertures 94. The openings 94 extend through each support member from a front surface facing away from the wall 14 to a rear surface facing the wall when the exercise rack 10 is in the extended exercise position. The openings 94 are adapted to removably receive support brackets 12. The support brackets may be comprised of various types of bar catchers such as, but not limited to, a J-cup (a.k.a. a J-hook) commonly utilized with conventional squat racks to removably receive and support a barbell 16 as illustrated in FIGS. 1 and 17A. The support brackets 12 have a pin that removably inserts into a selected opening or aperture 94 at a selected height along the length of the support members based on the height of the user or an exercise bench and/or the type of exercise being performed. The front portion of the support brackets 12 includes a hook structure that supports the barbell 16 in a stationary position with respect to the support members 40, 42. The support brackets 12 further include an L-shaped structure that extends around and behind the support members 40 42 to prevent accidental removal of the support brackets during an exercise.

In a preferred embodiment, the openings or apertures 94 are spaced apart vertically in approximately two inch intervals with the lowest aperture on a support member being located about two inches above the lower end of the support member. Thus, assuming the lower mounting plate 30 is attached to the wall 14 so that the lower extension members 36, 38 are about 7.5 inches above the floor 18, it would be suitable to attach each support member 40, 42 to the corresponding lower extension member 36 or 38 at about the second and fifth apertures from the lower end of the support member. For each two inches higher the lower mounting plate is attached to the wall, the support members can be attached to the corresponding extension members one aperture higher.

As previously described, the folding exercise rack 10 can assume an extended exercise position (e.g., see FIGS. 1, 8A, 8E, 10A, 11, 17A) and a plurality of retracted compact storage positions (e.g., see FIGS. 3, 8C, 8D, 8G, 8H, 9, 10B, 17C, 18-21). In the extended exercise position, the support members 40, 42 are positioned distally away from the wall 14 and in the retracted position they are positioned substantially parallel with and closely adjacent to the wall 14. The support members pivot laterally between the extended and retracted positions as the extension members to which they are connected pivot about the vertical axes of their pivotable connections to the mounting brackets. The support members therefore do not change height between the extended and retracted positions, which is a beneficial characteristic, particularly in rooms with low ceilings or with items or structures mounted to or suspended from the ceilings.

As is by now apparent, the distance between the wall and the surfaces of the support members farthest from the wall is significantly less when the exercise rack is in the retracted position than when the exercise rack is in the extended position. In the example embodiments, the distance from the wall to the farthest surfaces of the support members when the folding exercise rack is in the retracted compact storage position depends on which pivotable connection opening of the mounting brackets is selected for connecting the extension members. Depending on the opening selected, the distance ranges from little more than the width of the support members to approximately the width of the support members plus about three inches. Compare, e.g., FIGS. 10B and 21. The folding exercise rack thus provides the benefit of greatly reducing intrusion into and interference with the usage of the surrounding area (e.g., for parking a vehicle within a garage) as compared to other exercise racks and exercise equipment while providing a plurality of selectable retracted compact storage positions.

The example embodiments thus far described and illustrated pertain to an arrangement wherein the upright support members 40, 42 are each connected to a pair of upper and lower extension members 26, 36 and 28, 38, which are in turn connected to a pair of upper and lower mounting brackets 22, 32 and 24, 34, which are connected to the outer end portions of laterally extending upper and lower mounting plates 20, 30 fastened to a wall 14. However, it will be appreciated that numerous alternative arrangements are also possible.

For example, instead of each upper and lower mounting plate 20, 30 having a single upper or lower mounting bracket 22, 24 or 32, 34 and upper or lower pivotable extension member 26, 28 or 36, 38 attached at each end portion, it will be appreciated that each mounting plate may support a set of two or more mounting brackets and pivotable extension members. For example, the upper and lower mounting plates each may be rotated 90 degrees and extend along the surface of the wall substantially vertically rather than substantially horizontally. A set of two or more vertically-spaced mounting brackets can be attached to each mounting plate at the end portions and/or intermediate points, and can be used to pivotably support a corresponding number of vertically-spaced extension members. In this arrangement, the mounting plates would comprise left and right mounting plates with a plurality of left vertically-spaced mounting brackets and extension members pivotably connected to the left mounting plate, and a plurality of right mounting brackets and extension members pivotably connected thereto connected to the right mounting plate. The left and right upright support members would be connected to the distal ends of the plurality of left and right extension members respectively.

E. Pivotable Exercise Bar

While it is not necessary for the first and second support members 40, 42 to be directly connected in addition to their indirect connections through the upper and lower mounting plates 20, 30, the support members may be directly connected by a cross member or exercise bar 96 if desired for exercise purposes. The exercise bar may function as a pull-up bar for example. In that case, the exercise bar preferably will be connected between the support members near their respective upper ends so as to not interfere with other exercises a user may wish to perform between the support members at a lower level.

FIGS. 1-2, 5-6, 17A and 17B illustrate the exercise bar 60 connected between upper portions of the first support member 40 and the second support member 42. The connections between the opposite ends of the exercise bar 60 and the support members 40, 42 are selectively pivotable and removable to enable the bar to be repositioned to a retracted storage position as described below.

As illustrated in FIGS. 12 and 13A-C, the exercise bar 96 is connected to the support members 40, 42 by pivotable and removable connections established by a pair of L-shaped end brackets 98 at opposite ends of the exercise bar and a pair of twistable push pins 100. Each bracket includes a threaded opening or aperture. The aperture may be aligned with an aperture 94 on the front surface of the support member to which the end of the exercise bar is to be connected. The twist pins 100 each have a threaded distal end. A twist pin is inserted into the corresponding aperture 94 on the back face of the support member, extends through the support member into contact with the threaded aperture of the bracket, and is twisted until the bracket is securely engaged against the front surface of the support member. The same operation is performed to securely engage the bracket on the opposite end of the exercise bar to the other support member.

Either connection may be removed by twisting the push pin 100 until it disengages from the threaded aperture on the bracket 98 and then removing it. Alternatively, either connection may be made pivotable by twisting the push pin 100 to loosen the threaded engagement with the bracket. The push pin then functions as a horizontal pivot axis about which the end of the exercise bar 96 may pivot vertically when the push pin holding the opposite end of the exercise bar is removed.

Figure 12:
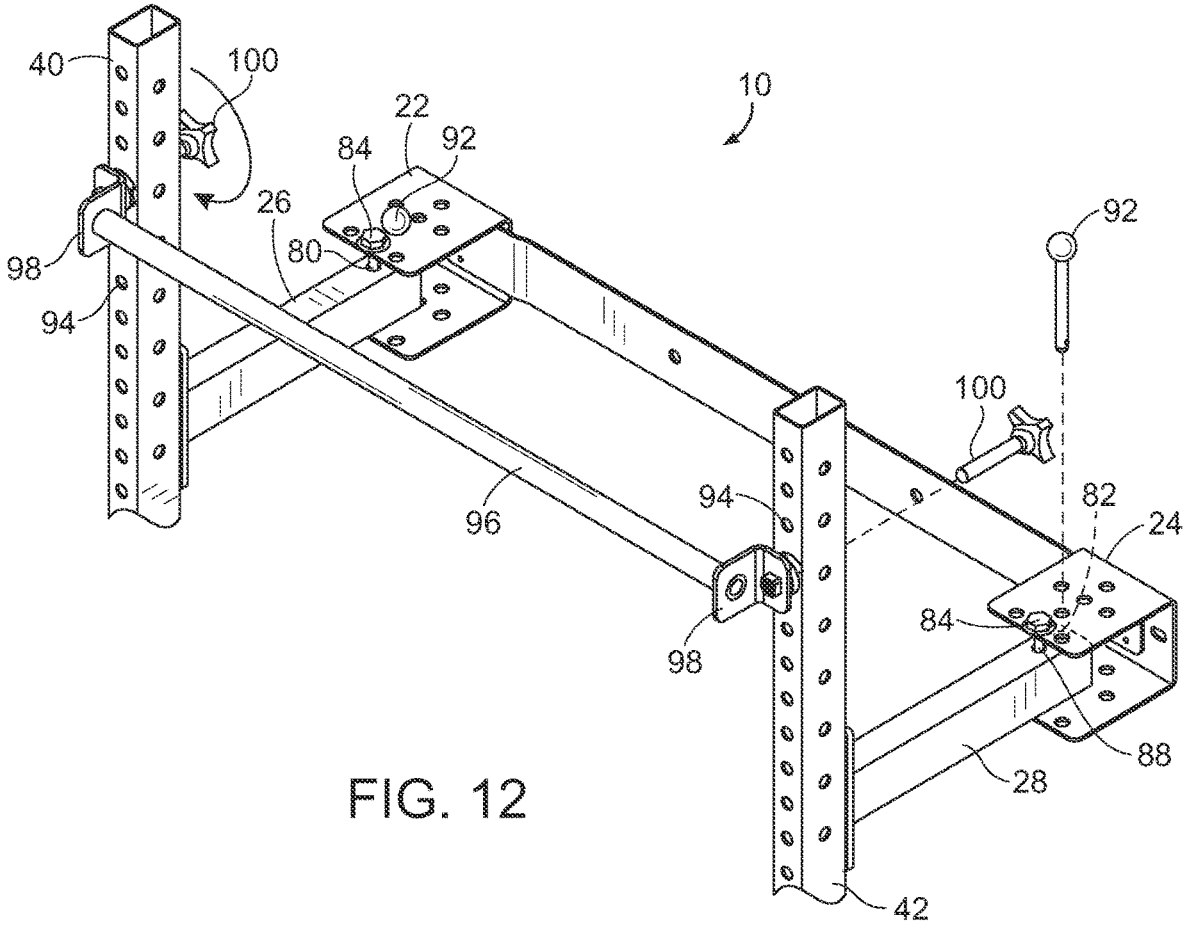
FIG. 12 is a partial front perspective view of a folding exercise rack with an exercise bar and a first removable twist pin removed from a first end of the exercise bar in accordance with an example embodiment.

This functionality facilitates secure and compact storage of the exercise bar along with the complete exercise rack 10 without the need to disassemble the exercise rack. As illustrated in FIG. 12, when the exercise rack is to be repositioned from the extended exercise position and folded into the retracted storage position, a first twist pin 100 at a first end of the exercise bar is twisted until it disengages from a first end bracket 98 of the exercise bar. The first twist pin is then removed, releasing the first end of the exercise bar from the first support member 42 to which it was connected. A second push pin 100 at the opposite second end of the exercise bar is twisted until the threaded engagement with a second end bracket 98 at the second end of the exercise bar is loosened. As illustrated in FIGS. 13A and 13B, the first end of the exercise bar 96 is then pivoted downwardly on the pivot axis provided by the loosened twist pin until the exercise bar vertically aligns with the opposite second upright support member 40 and the threaded aperture of the first end bracket is aligned with an aperture 94 on the front surface of the second support member. As illustrated in FIG. 13C, the first push pin 100 is then inserted through the corresponding aperture 94 on the back surface of the second support member 40 until it engages the threaded aperture and is twisted until the first end bracket is securely engaged against the second support member for storage.

Figure 2:
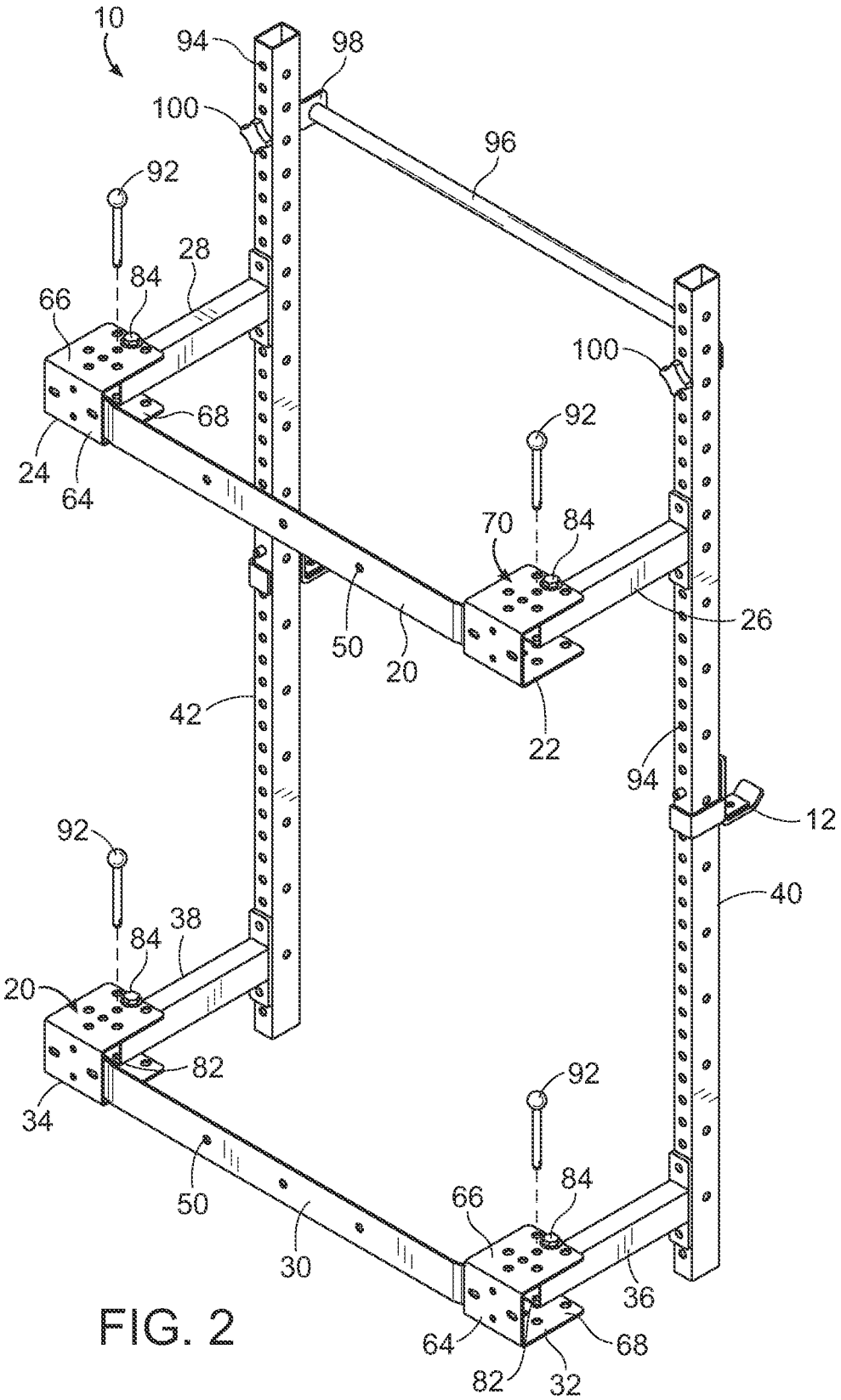
FIG. 2 is a rear perspective view of a folding exercise rack in an extended exercise position in accordance with an example embodiment.

The height of the exercise bar 96 may be adjusted simply by selecting the corresponding apertures 94 at the desired height on each of the support members 40, 42 and then securing the end brackets 98 of the exercise bar to the support members through those apertures as described above. In an example embodiment with apertures 94 vertically spaced about every two inches along the lengths of the support members 40, 42, the support members connected to the upper extension members 26, 28 at a height ranging from about 63.5-83.5 inches above floor level as previously described, and the lower ends of the support members in engagement with the floor 18 or other substantially horizontal support surface, exercise bar heights in a range from about 72 to 88 inches above floor level can be obtained by connecting the exercise bar to the support members through corresponding selected apertures. For example, connecting the exercise bar to the support members through the corresponding apertures six down from the tops of the support members produces a height near the upper end of the range, while mounting it through corresponding apertures 10 down from the tops of the support members produces a height near the lower end of the range. The mounting location of the exercise bar on the support members should be selected so as not to interfere with the mounting locations of the upper extension members, as seen in FIGS. 1-2 for example.

Although one exercise bar 60 is described and shown, it will be appreciated that multiple exercise bars could be connected between the support members at different heights if desired. In addition, multiple exercise bars could be connected and extend outwardly from the front faces of the support members by different distances at either the same or different heights by adjusting the dimensions of the bracket 98 and/or including additional brackets with different dimensions to accommodate multiple exercise bars. Such an arrangement with multiple bars (60 and 62) is illustrated and described in U.S. Pat. No. 9,993,678, which is assigned to the assignee of the present application, and which is hereby incorporated by reference.

F. Operation of Preferred Embodiment

Figure 9:
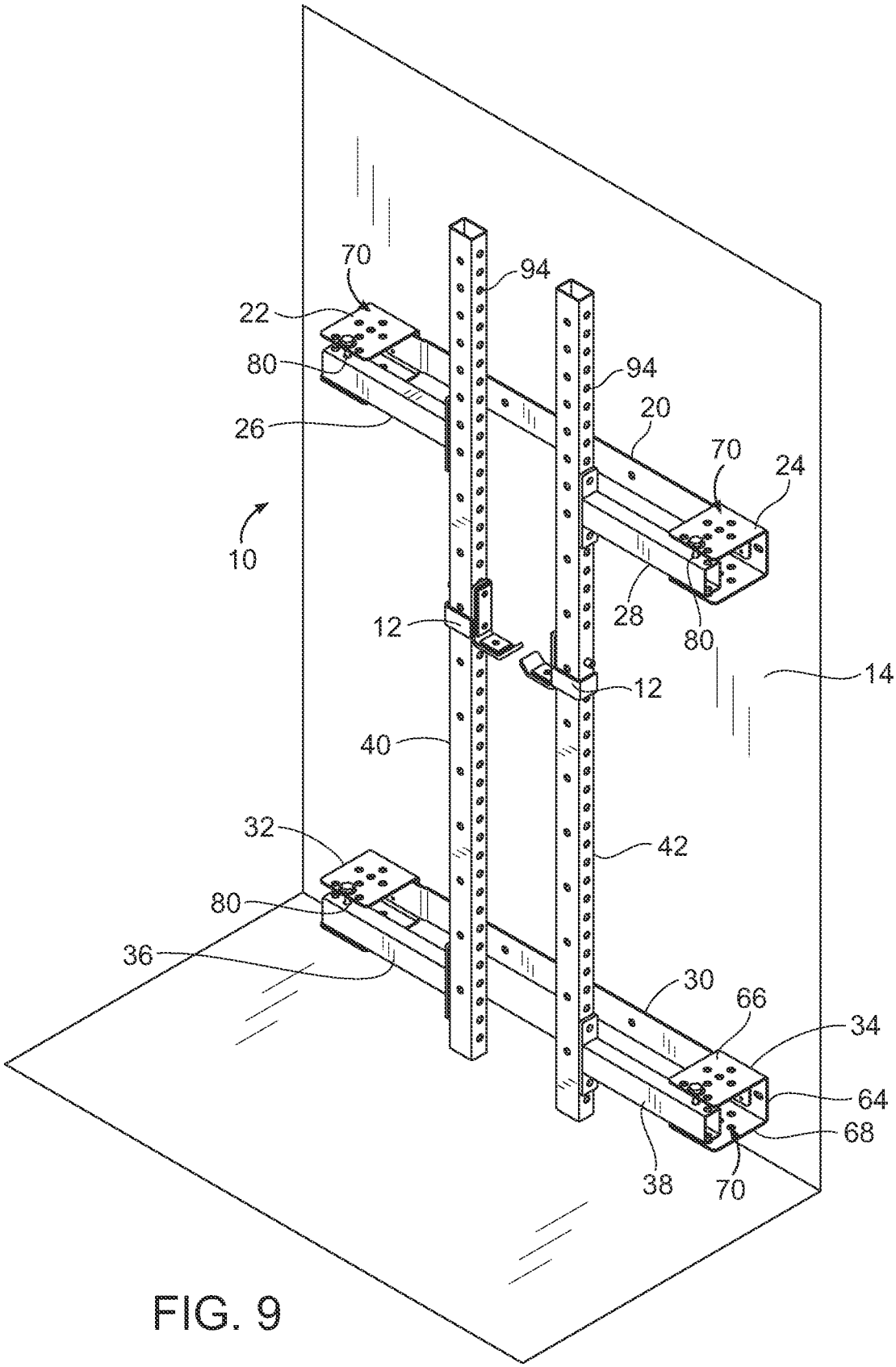
FIG. 9 is a front perspective view of a folding exercise rack attached to a wall in a first retracted compact storage position with support members engaged with a floor and extension members pivotably connected to mounting brackets at a first pivotable connection point in accordance with an example embodiment.
Figure 10A:
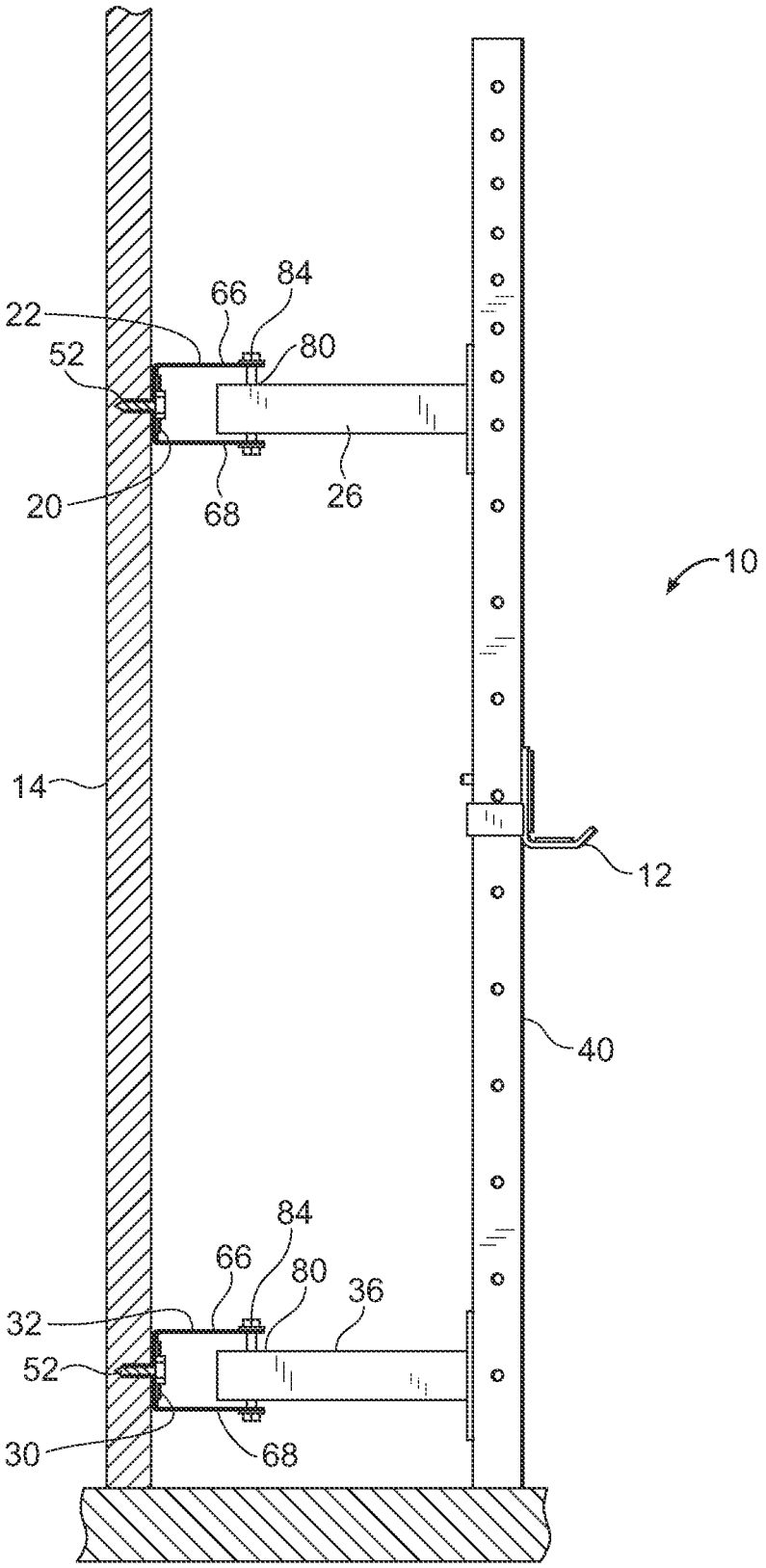
FIG. 10A is a side view of a folding exercise rack attached to a wall in an extended exercise position with support members engaged with a floor and extension members pivotably connected to mounting brackets at a first pivotable connection point in accordance with an example embodiment.
Figure 10B:
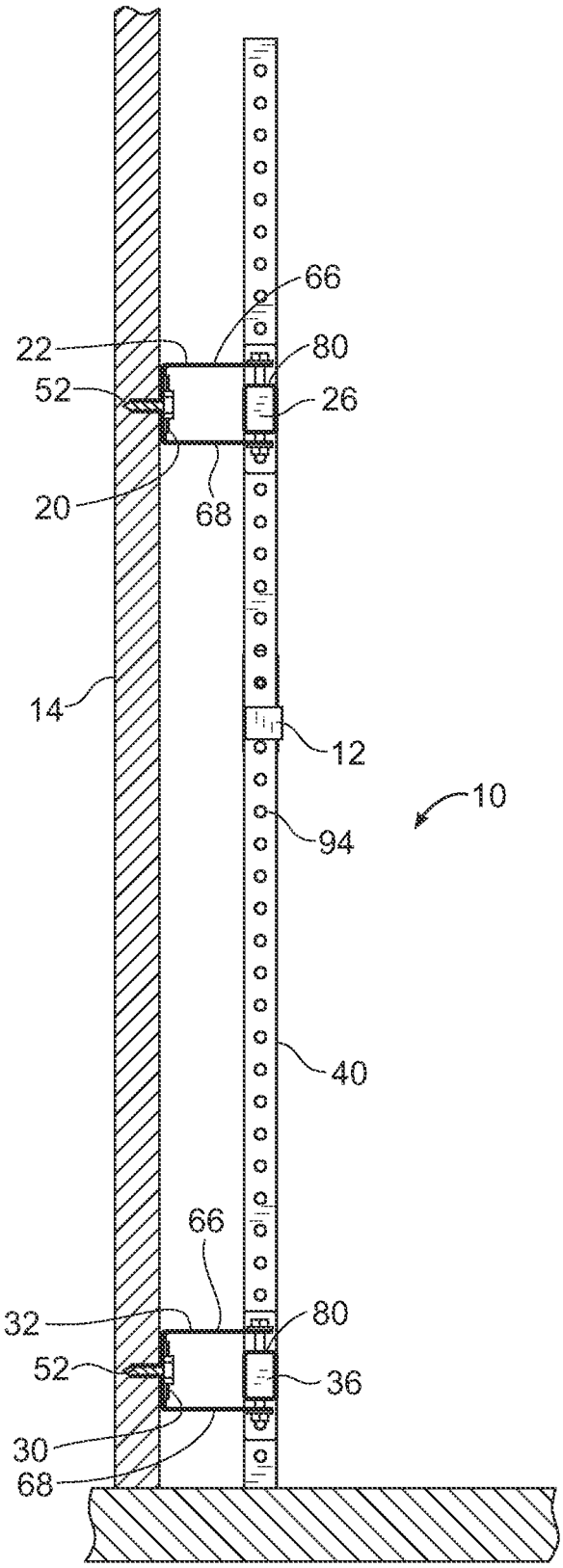
FIG. 10B is a side view of a folding exercise rack attached to a wall in a first retracted compact storage position with support members engaged with a floor and extension members pivotably connected to mounting brackets at a first pivotable connection point in accordance with an example embodiment.
Figure 11:
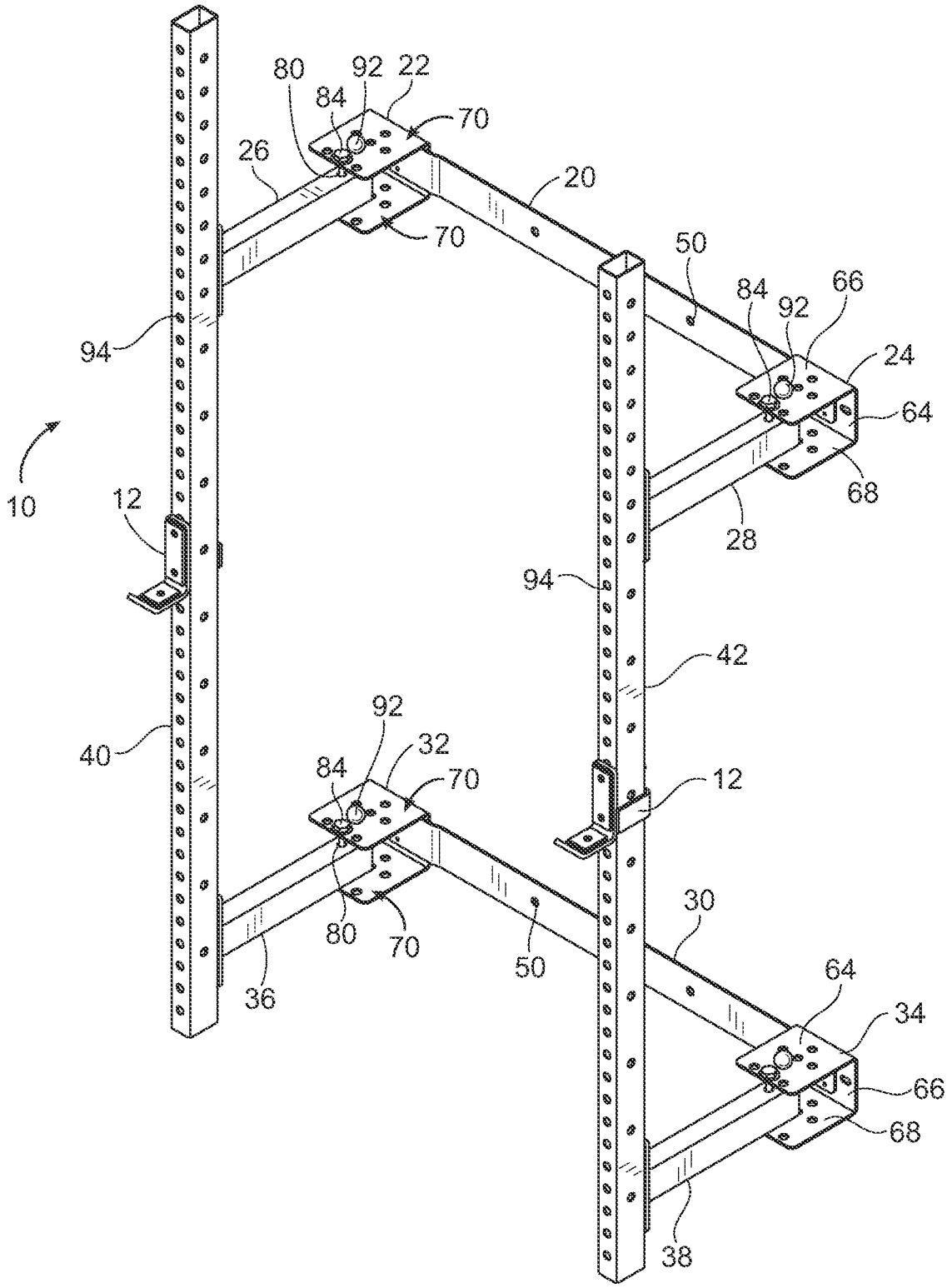
FIG. 11 is front perspective view of an alternative embodiment for a folding squat rack without an exercise bar in an extended exercise position in accordance with an example embodiment.

In use, the folding exercise rack is first assembled and affixed to the wall 14 as follows. The upper and lower mounting brackets 22, 24, 32, 34 are connected to the upper and lower mounting plates 20, 30 as illustrated in FIGS. 1-6 and others, and as described herein. The upper and lower mounting plates 20, 30 are then mounted to the wall 14 as illustrated in FIGS. 8-10 and described herein. The upper and lower extension members 26, 28, 36, 38 are pivotably connected at their proximal ends to respective upper and lower mounting brackets 22, 24, 32, 34 as illustrated in FIGS. 1-4, 7-12, and 14-16, and as described herein. The upper and lower extension members are pivotably connected via a selected one of the openings 72, 74 on each bracket to select the distance from the wall the exercise rack will extend in the exercise position and determine how much space will be present between the wall and the exercise rack in the plurality of selectable retracted storage positions as illustrated in FIGS. 14-16, 8C, 8D, 8G, 8H, 10B, and 21. The upright support members 40, 42 are connected to the distal ends of the respective upper and lower extension members as illustrated in FIGS. 1-7, 9-11, and others, and as described herein.

If desired, support brackets or J-cups 12 are connected to the front faces of the support members to support a barbell 16 or the like at a desired height as illustrated in FIGS. 1-4, 9-11, and others, and as described herein. If desired, a retractable exercise bench 60 is mounted to the wall 14 in the space between the upright support members in the manner described in U.S. Pat. No. 10,195,479 and as illustrated in FIGS. 17-20. In that case, openings 72 of the mounting brackets 22, 24, 32, 34 should be selected to pivotably connect the respective extension members 26, 28, 36, 38. Finally, if desired, an exercise bar 96 is connected between the support members at a desired height as illustrated in FIGS. 1-2, 5-7, 12, and others, and as described. A major benefit of the example embodiments is that once the exercise rack is assembled it need not be disassembled for storage.

Figure 3:
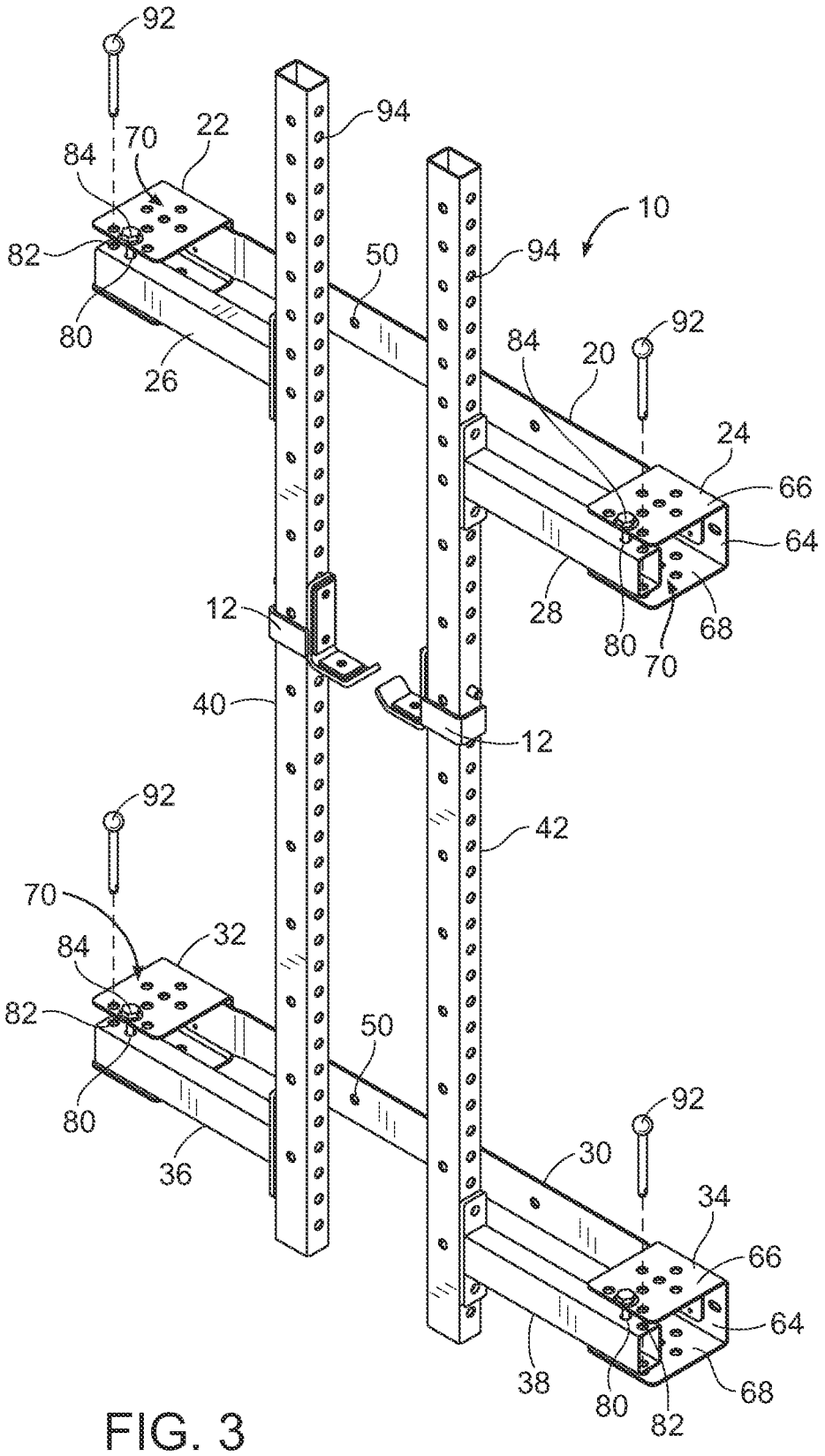
FIG. 3 is a front perspective view of a folding exercise rack in a retracted compact storage position in accordance with an example embodiment.
Figure 4:
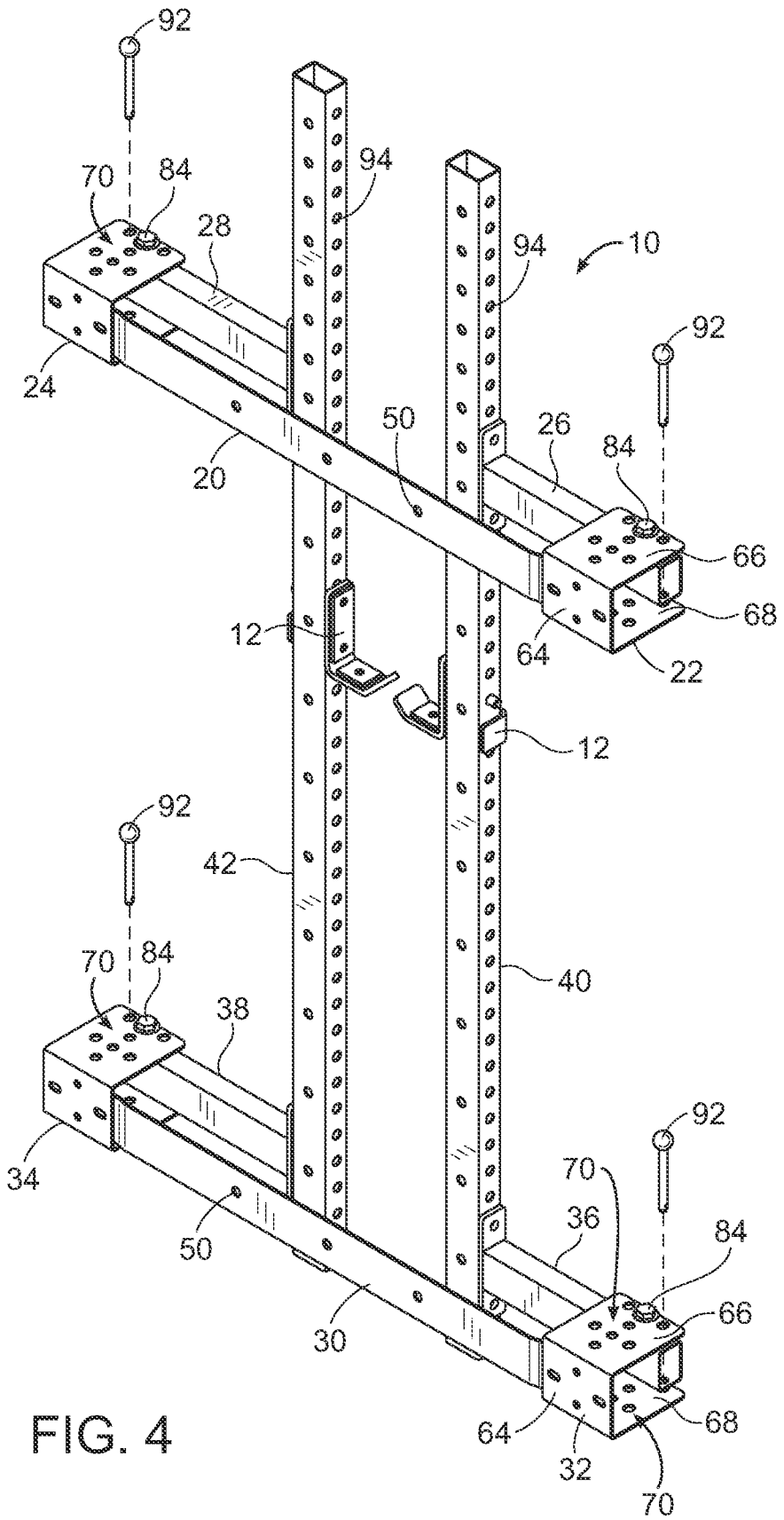
FIG. 4 is a rear perspective view of a folding exercise rack in a retracted compact storage position in accordance with an example embodiment.
Figure 5:
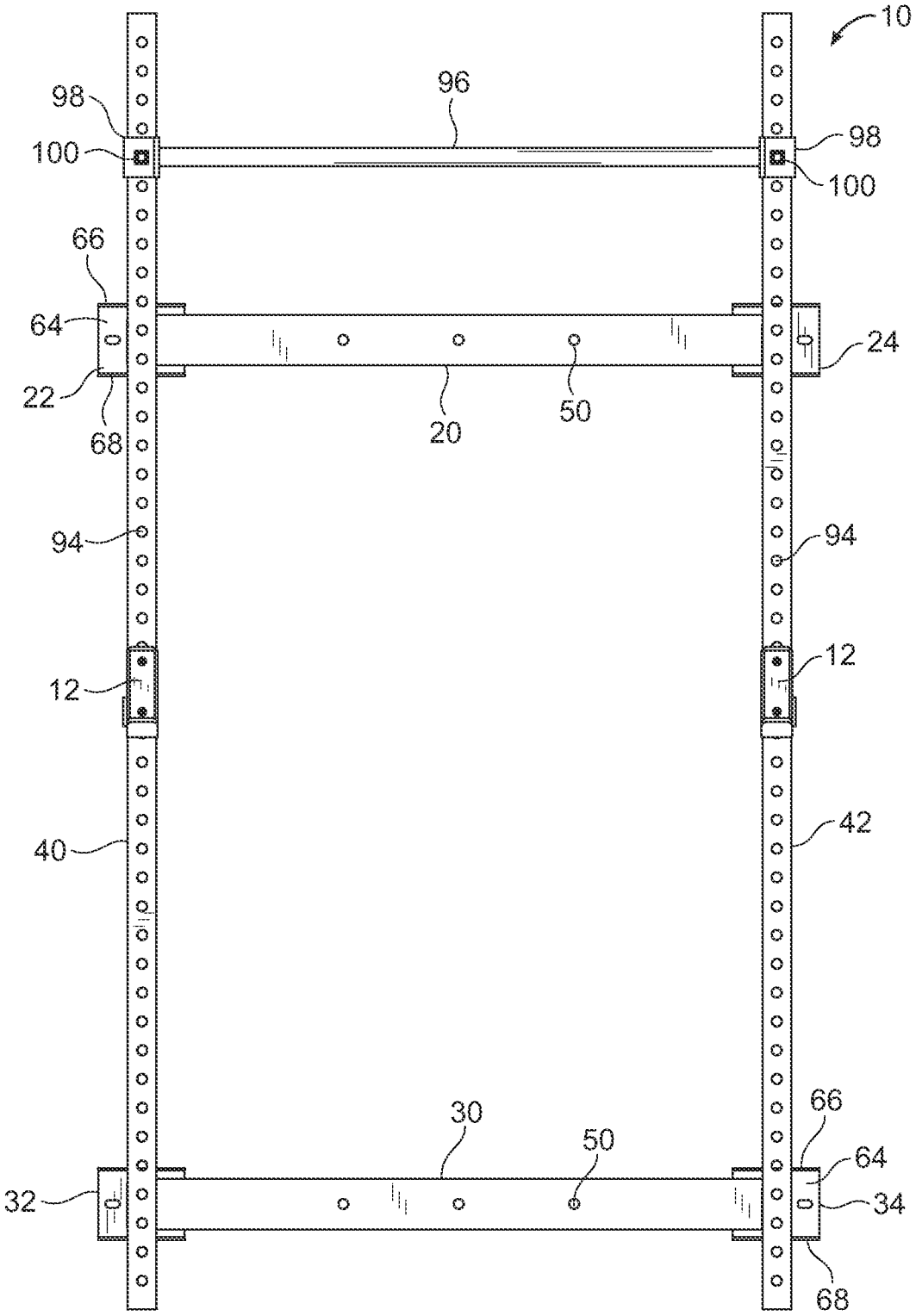
FIG. 5 is a front view of a folding exercise rack in an extended exercise position in accordance with an example embodiment.
Figure 6:
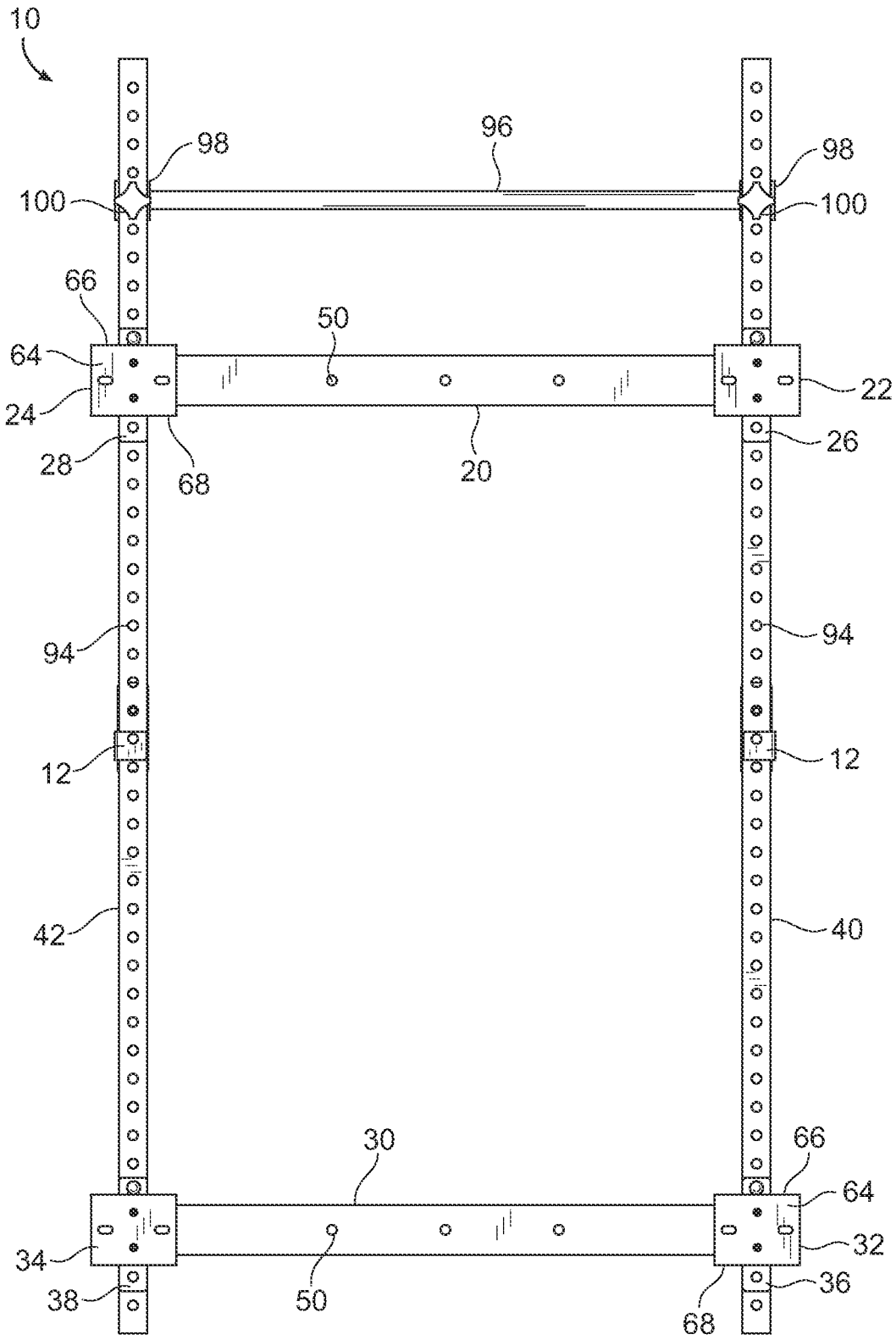
FIG. 6 is a rear view of a folding exercise rack in an extended exercise position in accordance with an example embodiment.
Figure 7:
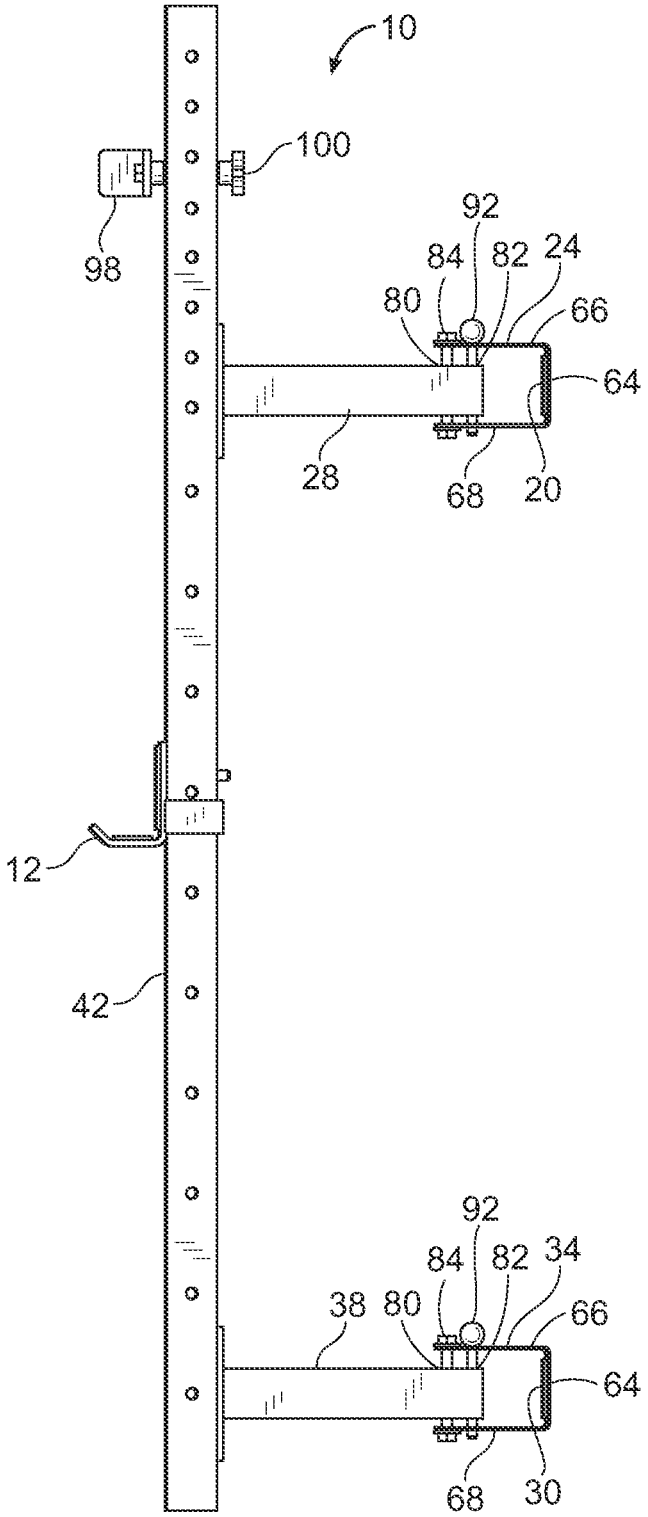
FIG. 7 is a side view of a folding exercise rack in an extended exercise position in accordance with an example embodiment.
Figure 8A:
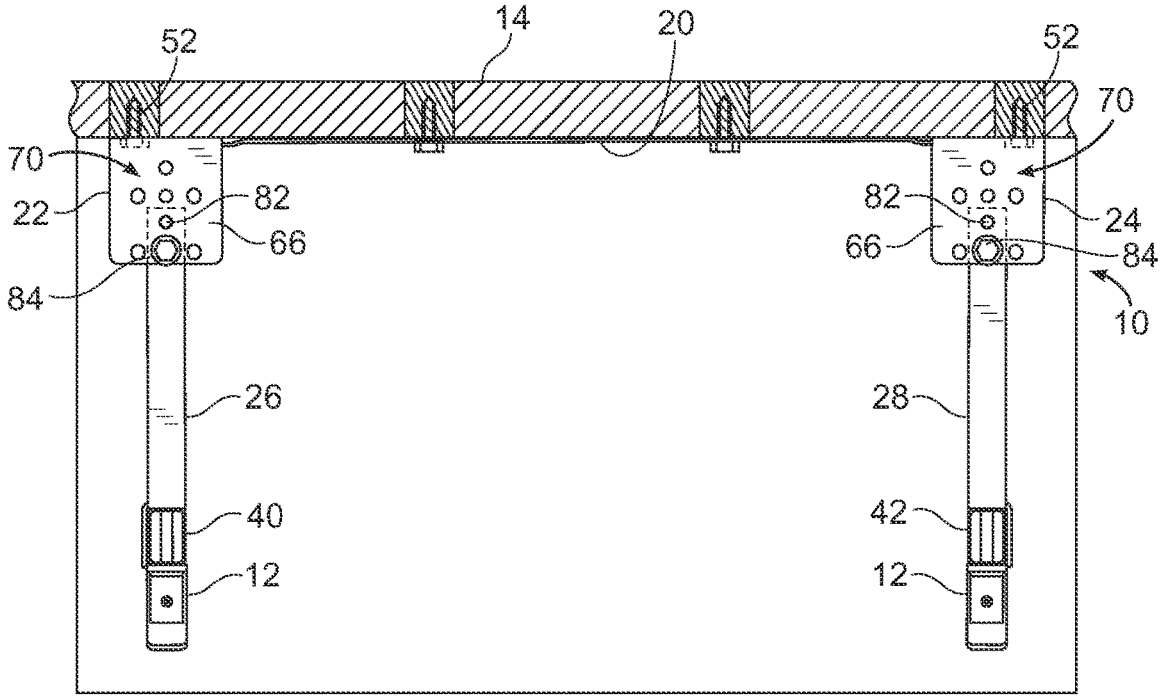
FIG. 8A is a top view of a folding exercise rack secured to a wall in an extended exercise position with extension members pivotably connected to mounting brackets at a first pivotable connection point in accordance with an example embodiment.
Figure 8B:
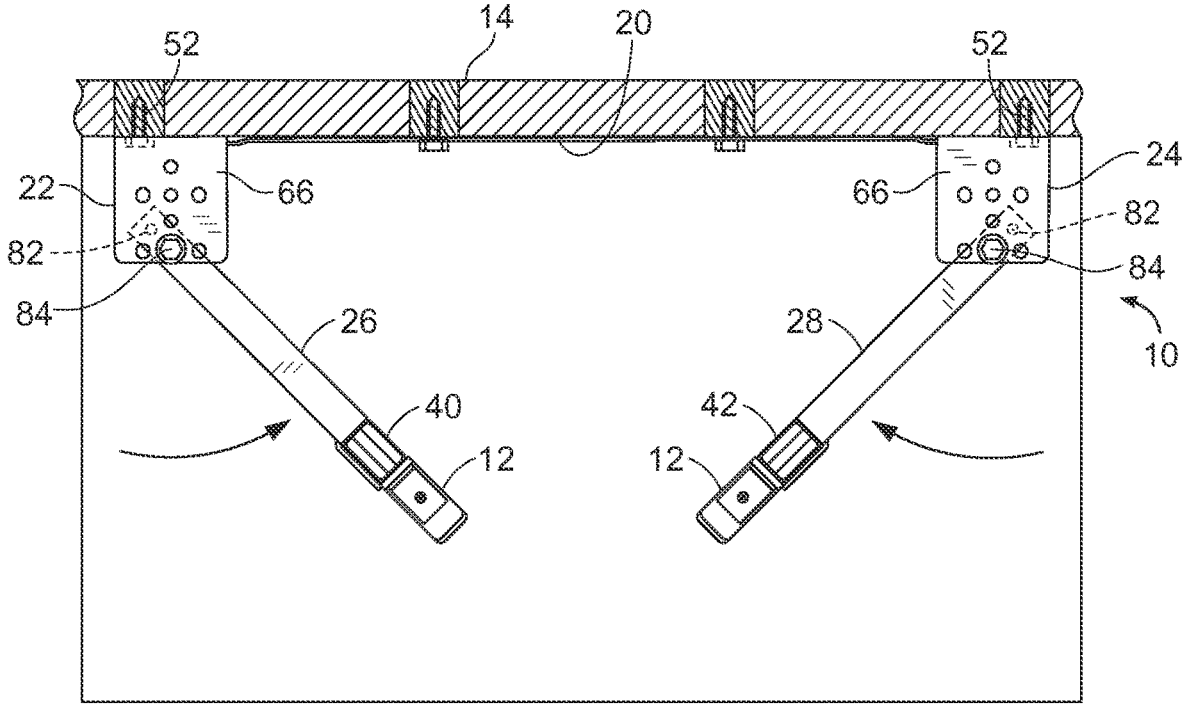
FIG. 8B is a top view of a folding exercise rack secured to a wall and pivoting from an extended exercise position to a first retracted compact storage position with extension members pivotably connected to mounting brackets at a first pivotable connection point in accordance with an example embodiment.
Figure 8C:
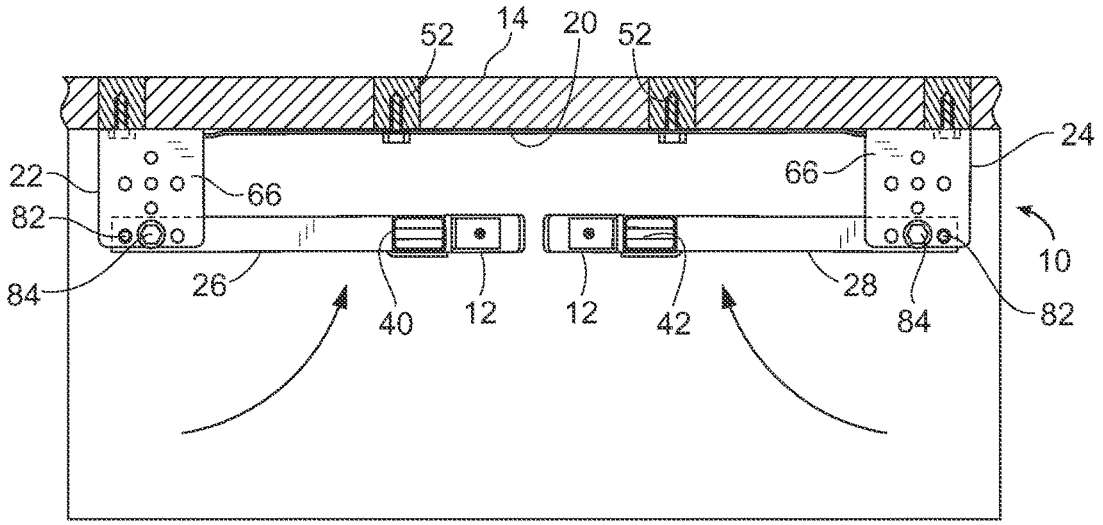
FIG. 8C is a top view of a folding exercise rack secured to a wall in a first retracted compact storage position with extension members pivotably connected to mounting brackets at a first pivotable connection point and folded inwardly toward each other in accordance with an example embodiment.
Figure 8D:
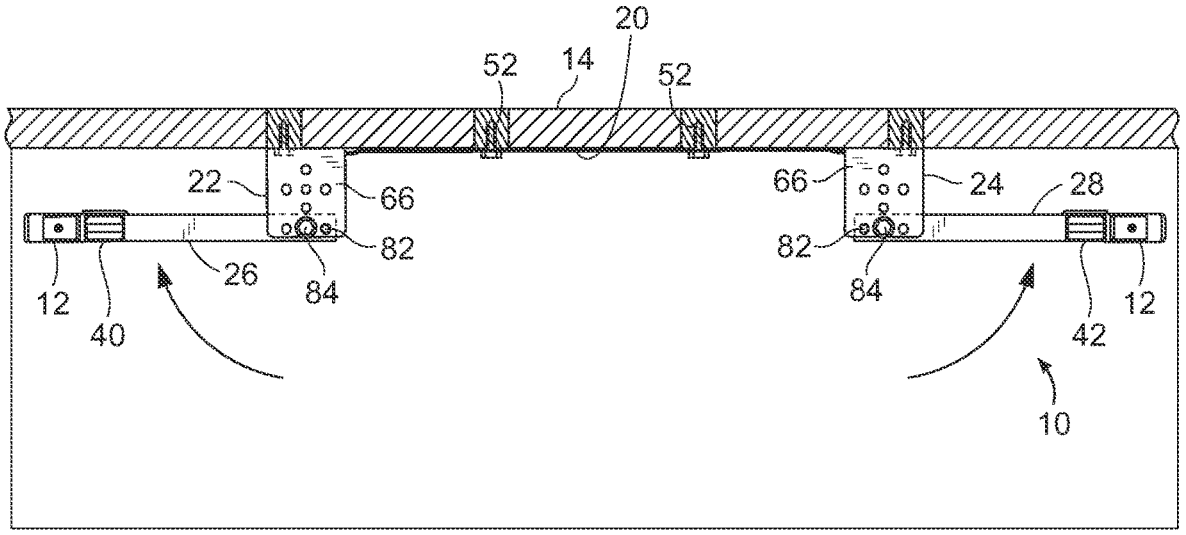
FIG. 8D is a top view of a folding exercise rack secured to a wall in an alternative first retracted compact storage position with extension members pivotably connected to mounting brackets at a first pivotable connection point and folded outwardly away from each other in accordance with an example embodiment.
Figure 8E:
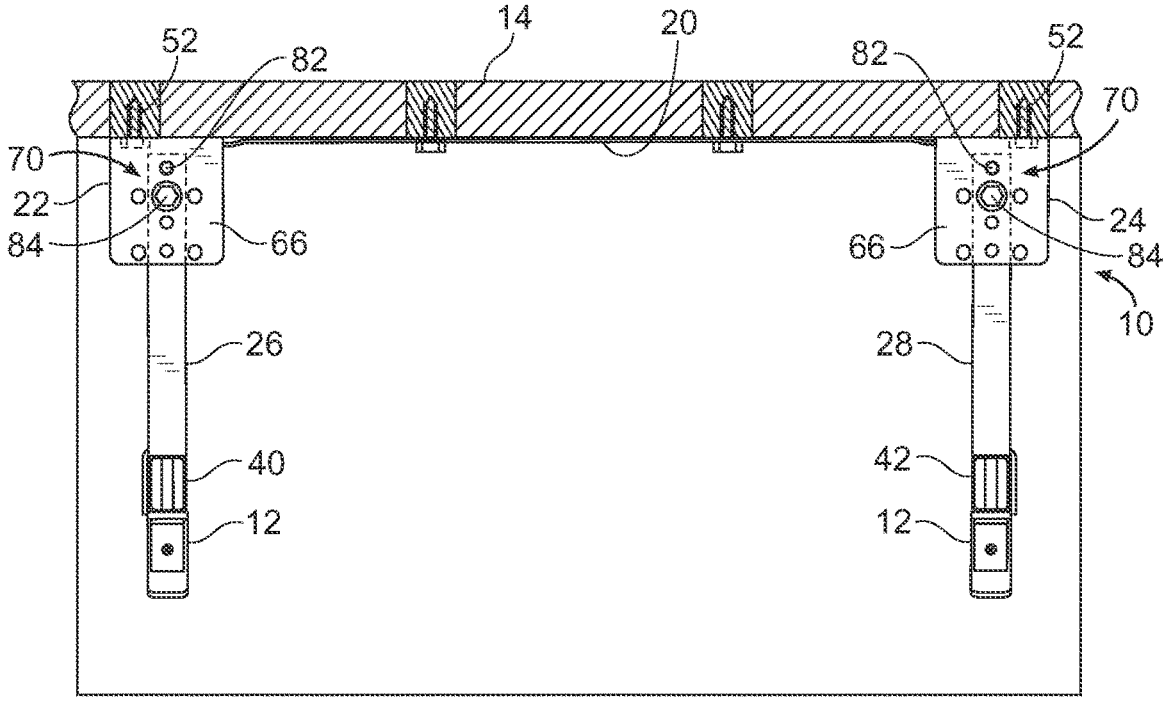
FIG. 8E is a top view of a folding exercise rack secured to a wall in an extended exercise position with extension members pivotably connected to mounting brackets at a second pivotable connection point in accordance with an example embodiment.
Figure 8F:
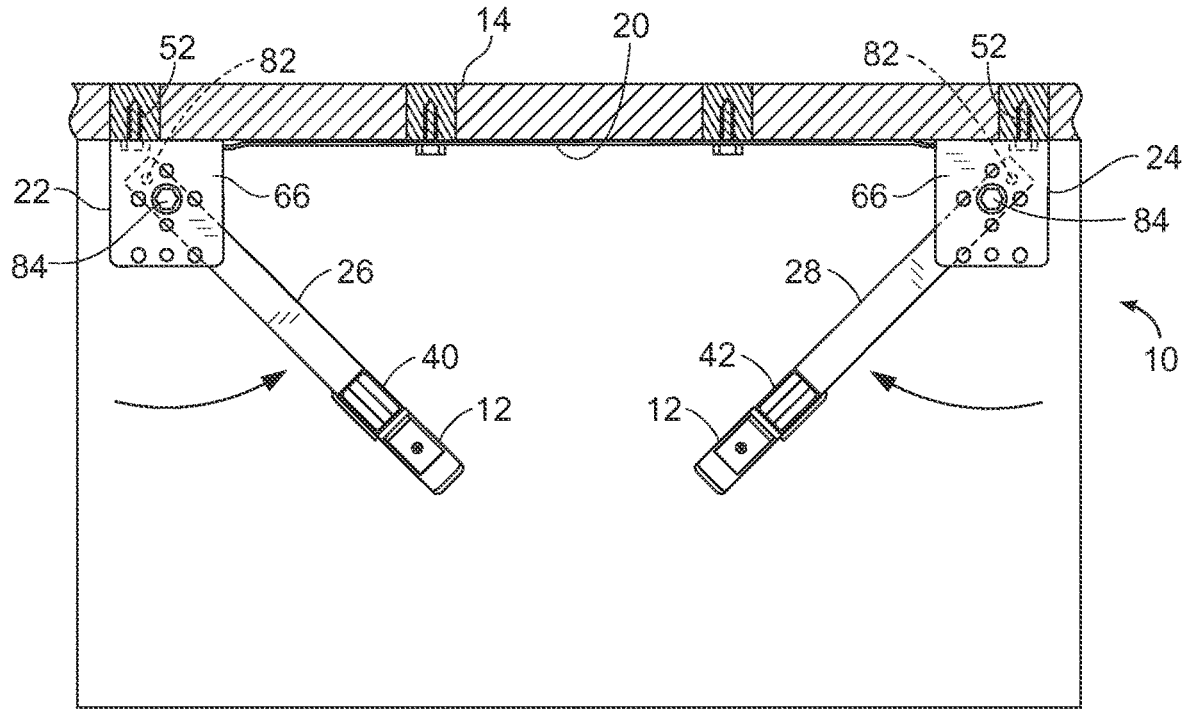
FIG. 8F is a top view of a folding exercise rack secured to a wall and pivoting from an extended exercise position to a second retracted compact storage position with extension members pivotably connected to mounting brackets at a second pivotable connection point in accordance with an example embodiment.
Figure 8G:
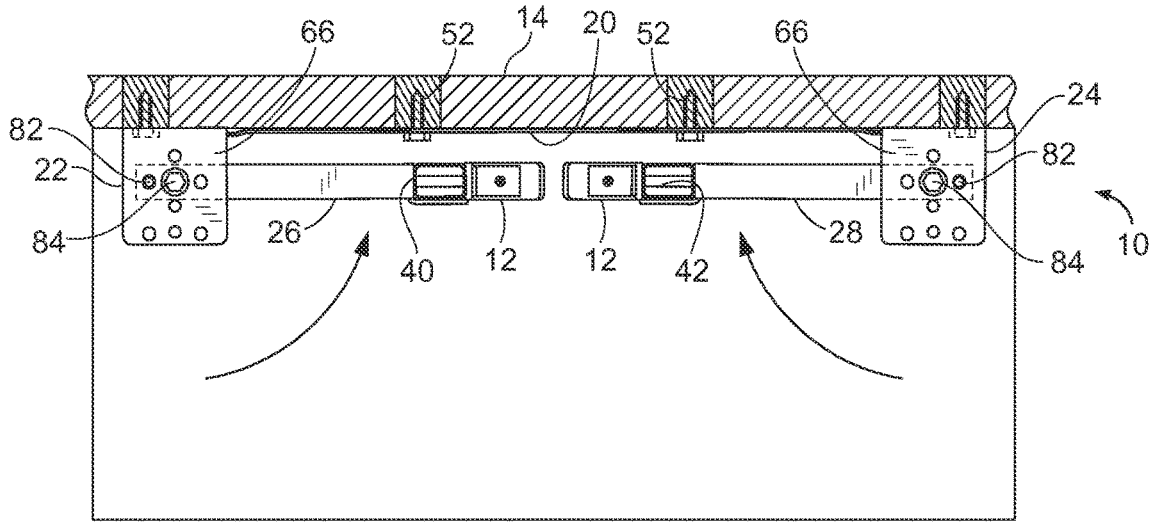
FIG. 8G is a top view of a folding exercise rack secured to a wall in a second retracted compact storage position with extension members pivotably connected to mounting brackets at a second pivotable connection point and folded inwardly toward each other in accordance with an example embodiment.
Figure 8H:
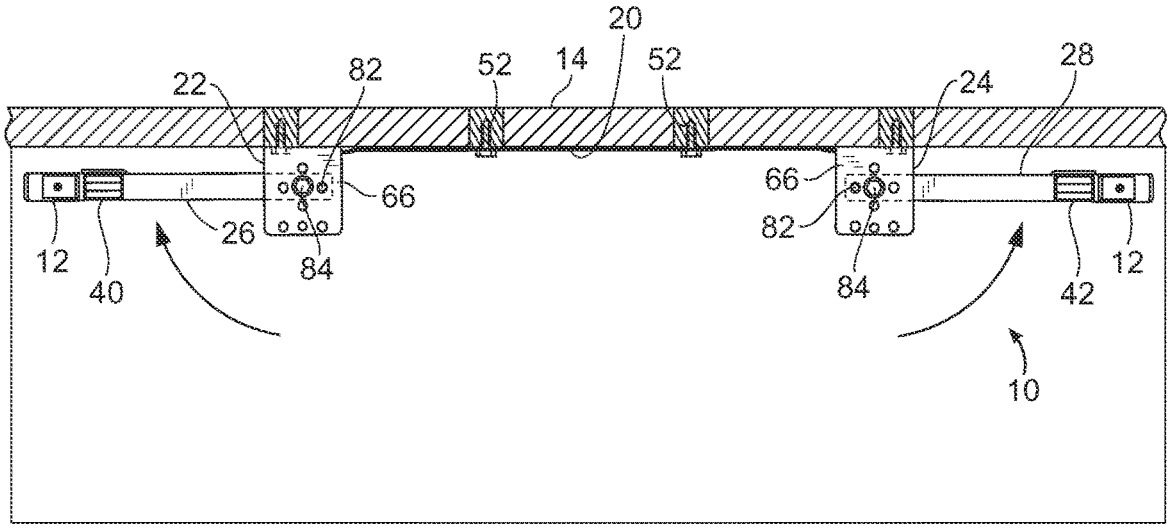
FIG. 8H is a top view of a folding exercise rack secured to a wall in an alternative second retracted compact storage position with extension members pivotably connected to mounting brackets at a second pivotable connection point and folded outwardly away from each other in accordance with an example embodiment.

Starting from one of the plurality of retracted storage positions as illustrated in FIGS. 8C, 8D, 8G, 8H, 9, 10B and 13C, and 17C-20 (if a retractable exercise bench is included), the upright support members 40, 42 are pivoted outwardly from the wall 14 as illustrated in FIGS. 8A-8C and 8E-8G, for example, to the fully extended exercise position illustrated in FIGS. 1, 2, 7, 8A, 8E, 10A, 11, and 17A in the manner described herein. If the exercise rack was locked in the retracted storage position, the removable locking pins 92 are first removed from aligned apertures 82 of the extension members 26, 28, 36, 38 and 88 of the respective mounting brackets 22, 24, 32, 34 as illustrated in FIGS. 3-4 and as described herein.

Once the exercise rack is in the fully extended exercise position, the apertures 82 in the proximal ends of the extension members 26, 28, 36, 38 are aligned with the locking openings 86 on the respective mounting brackets 22, 24, 32, 34 as illustrated in FIGS. 1-2, 7, 8A, 11 12, 16, and 17A, and removable locking pins 92 are extended through the aligned apertures to lock the exercise rack in the exercise position as described herein. If a retractable bench 60 is included, it is extended from the wall into the exercise position as shown and described in U.S. Pat. No. 10,195,479 and as illustrated in FIG. 17A.

With the exercise rack in the extended exercise position, a user is able to perform various desired exercises such as, but not limited to, pull-ups, squats, bench presses, and the like. The user may also adjust the desired position of the support brackets 12 to support the barbell 16 at the desired height, as well as the height of the exercise bar 96.

When the user is finished exercising and wishes to reposition the exercise rack into one of the plurality of selectable retracted compact storage positions illustrated in FIGS. 3, 4, 8C, 8D, 8G, 8H, 9, 10B, 13C, 17C, and 18-21, the barbell 16 and any attached weights are removed. If the exercise rack was locked in the exercise position, the user unlocks it by removing the removable locking pins 92 from the aligned apertures 82 in the proximal ends of the extension members 26, 28, 36, 38 and locking openings 86 in the respective mounting brackets 22, 24, 32, 34 as illustrated in FIGS. 1-2 and others.

The retractable exercise bench 60, if used, is repositioned into the retracted storage position against the wall 14 as shown and described in U.S. Pat. No. 10,195,479 and as illustrated in FIGS. 17C and 18-21. The exercise bar 96, if installed, is repositioned for storage by disconnecting the first end of the bar from a first one of support members 40 or 42, loosening the connection between the opposite second end of the bar and the opposite second support member 40 or 42, pivoting the first end of the bar downwardly into vertical alignment with the second support member, and connecting the first end of the bar to the second support member as illustrated in FIGS. 12-13 and described herein.

The upright support members 40, 42 are then pivoted either inwardly toward each other, as illustrated in FIGS. 8A-8C and 8E-8G, or outwardly away from each other until they are in a selected retracted compact storage position substantially parallel with and closely adjacent to the wall 14 as illustrated in FIGS. 3, 4, 8C, 8D, 8G, 8H, 9, 10B, 13C, 17C and 18-21, and as described herein. In the retracted storage position, the apertures 82 in the proximal ends of the extension members 26, 28, 36, 38 are aligned with a selected one of the locking openings 88 or 90 on the respective mounting brackets 22, 24, 32, 34, depending on whether the support members were pivoted toward or away from each other. To ensure that the exercise rack is not accidentally or inadvertently allowed to extend and retract when not intended and perhaps cause injury or damage, it is advisable that it be locked in the retracted storage position when not in use. The removable locking pins 92 are extended through the aligned apertures 82 and either 88 or 90 to lock the exercise rack in the storage position as illustrated in FIGS. 3-4 and others.

The above process is repeated for each desired use and storage of the exercise rack.

Unless otherwise defined, all technical and scientific terms used herein have the same meaning as commonly understood by one of ordinary skill in the art to which this invention belongs. Although specific terms are employed herein, they are used in a generic and descriptive sense only and not for purposes of limitation. Any headings utilized within the description are for convenience only and have no legal or limiting effect. All publications, patent applications, patents, and other references mentioned herein are incorporated by reference in their entirety to the extent allowed by applicable law and regulations.

Although methods and materials similar to or equivalent to those described herein can be used in the practice or testing of the folding exercise rack system, suitable methods and materials are described above. It is understood that the folding exercise rack system may be embodied in other specific forms without departing from the spirit or essential attributes thereof, and it is therefore desired that the embodiments described herein be considered in all respects as illustrative and not restrictive. Many modifications and other embodiments of the folding exerciser ack system will come to mind to those skilled in the art to which this invention pertains and having the benefit of the teachings presented in the foregoing description and the associated drawings. Therefore, it is to be understood that the invention is not to be limited to the specific embodiments disclosed and that modifications and other embodiments are intended to be included within the scope of the appended claims.

What is claimed is:

1. An exercise rack, comprising:

a first pair of brackets and a second pair of brackets, wherein each of the first pair of brackets and the second pair of brackets is securable to a wall;

a first pair of extension members, wherein each of the first pair of extension members is pivotably connected to one of the first pair of brackets;

a second pair of extension members, wherein each of the second pair of extension members is pivotably connected to one of the second pair of brackets;

a first support member connected to the first pair of extension members, wherein the first support member is vertically orientated, and wherein the first support member has a first front surface;

a second support member connected to the second pair of extension members, wherein the second support member is vertically orientated, and wherein the second support member has a second front surface;

wherein the first support member and the second support member each have an exercise position where the first support member and the second support member are positioned outwardly from the wall;

wherein the first support member and the second support member each have a storage position where the first support member and the second support member are positioned inwardly near the wall; and a cross member having a first end and a second end, wherein the first end of the cross member is pivotally connected about a horizontal axis to the first front surface of the first support member in the exercise position, and wherein the second end of the cross member is removably connected to the second front surface of the second support member in the exercise position.

2. The exercise rack of claim 1, wherein the cross member is pivotable into a storage position parallel and adjacent to the first front surface of the first support member when the second end of the cross member is disconnected from the second front surface of the second support member.

3. The exercise rack of claim 2, wherein the cross member extends horizontally between the first support member and the second support member when the second end of the cross member is connected to the second front surface of the second support member.

4. The exercise rack of claim 1, wherein the second end of the cross member is pivotally connected to the second support member.

5. The exercise rack of claim 4, wherein the first end of the cross member is removably connected to the first front surface of the first support member.

6. The exercise rack of claim 5, wherein the cross member is pivotable into a storage position parallel and adjacent to the second front surface of the second support member when the first end of the cross member is disconnected from the first front surface of the second support member.

7. The exercise rack of claim 1, wherein the cross member includes a first bracket extending from the first end of the cross member and a second bracket extending from the second end of the cross member, wherein the first bracket is pivotally connected to the first front surface of the first support member, and wherein the second bracket is removably connected to the second front surface of the second support member.

8. The exercise rack of claim 7, wherein the first bracket is pivotally connected to the first front surface of the first support member by a first pin and wherein the second bracket is removably connected to the second front surface of the second support member by a second pin.

9. The exercise rack of claim 8, wherein the first pin has a first threaded end that is threadably connected to a threaded opening within the first bracket, and wherein the second pin has a second threaded end that is threadably connected to a threaded opening within the second bracket.

10. The exercise rack of claim 8, wherein the cross member pivots about the first pin along a horizontal pivot axis, wherein the horizontal pivot axis is crosswise to a longitudinal axis of the cross member.

11. The exercise rack of claim 7, wherein the first bracket is removably connected to the first front surface of the first support member and the second bracket is pivotally connected to the second front surface of the second support member.

12. The exercise rack of claim 7, wherein the first bracket is parallel and adjacent to the first front surface of the first support member and wherein the second bracket is parallel and adjacent to the second front surface of the second support member.

13. The exercise rack of claim 7, wherein the first bracket and the second bracket each are comprised of an L-shaped bracket having a first segment and a second segment extending from the first segment, wherein the first segment of the first bracket is connected to the first end of the cross member, wherein the second segment of the first bracket is connected to the first front surface of the first support member, wherein the first segment of the second bracket is connected to the second end of the cross member, and wherein the second segment of the second bracket is connected to the second front surface of the second support member.

14. The exercise rack of claim 1, wherein a height of the cross member is configured to be adjusted to a selected height.

15. The exercise rack of claim 1, wherein the cross member is comprised of a pull-up bar.

16. A method of positioning the exercise rack of claim 1 from the exercise position to the storage position, comprising:

removing the second end of the cross member from the second support member;

pivoting the cross member downwardly until the cross member is vertically orientated and parallel to the first front surface of the first support member; and positioning the first support member and the second support member into the storage position.

17. An exercise rack, comprising:

a first pair of brackets and a second pair of brackets, wherein each of the first pair of brackets and the second pair of brackets is securable to a wall;

a first pair of extension members, wherein each of the first pair of extension members is pivotably connected to one of the first pair of brackets;

a second pair of extension members, wherein each of the second pair of extension members is pivotably connected to one of the second pair of brackets;

a first support member connected to the first pair of extension members, wherein the first support member is vertically orientated, and wherein the first support member has a first front surface;

a second support member connected to the second pair of extension members, wherein the second support member is vertically orientated, and wherein the second support member has a second front surface;

wherein the first support member and the second support member each have a exercise position where the first support member and the second support member are positioned outwardly from the wall;

wherein the first support member and the second support member each have a storage position where the first support member and the second support member are positioned inwardly near the wall; and a cross member having a first end and a second end, wherein the first end of the cross member is pivotally connected to the first front surface of the first support member in the exercise position, and wherein the second end of the cross member is removably connected to the second front surface of the second support member in the exercise position;

wherein the cross member extends horizontally between the first support member and the second support member when the second end of the cross member is connected to the second front surface of the second support member;

wherein the cross member is pivotable into a storage position parallel and adjacent to the first front surface of the first support member when the second end of the cross member is disconnected from the second front surface of the second support member;

wherein the cross member is configured to be connected to various positions along the first support member and the second support member for a selected height;

wherein the second end of the cross member is pivotally connected to the second support member and wherein the first end of the cross member is removably connected to the first front surface of the first support member;

wherein the cross member is pivotable into a storage position parallel and adjacent to the second front surface of the second support member when the first end of the cross member is disconnected from the first front surface of the second support member.

18. A method of positioning the exercise rack of claim 17 from the exercise position to the storage position, comprising:

removing the second end of the cross member from the second support member;

pivoting the cross member downwardly until the cross member is vertically orientated and parallel to the first front surface of the first support member; and positioning the first support member and the second support member into the storage position.

19. An exercise rack, comprising:

a first pair of brackets and a second pair of brackets, wherein each of the first pair of brackets and the second pair of brackets is securable to a wall;

a first pair of extension members, wherein each of the first pair of extension members is pivotably connected to one of the first pair of brackets;

a second pair of extension members, wherein each of the second pair of extension members is pivotably connected to one of the second pair of brackets;

a first support member connected to the first pair of extension members, wherein the first support member is vertically orientated, and wherein the first support member has a first front surface;

a second support member connected to the second pair of extension members, wherein the second support member is vertically orientated, and wherein the second support member has a second front surface;

wherein the first support member and the second support member each have an exercise position where the first support member and the second support member are positioned outwardly from the wall;

wherein the first support member and the second support member each have a storage position where the first support member and the second support member are positioned inwardly near the wall; and a cross member having a first end and a second end, wherein the cross member is pivotally connected to the first front surface of the first support member in the exercise position, and wherein the cross member is removably connected to the second front surface of the second support member in the exercise position;

wherein the cross member extends horizontally between the first support member and the second support member when the second end of the cross member is connected to the second front surface of the second support member;

wherein the cross member is configured to be connected to various positions along the first support member and the second support member for a selected height;

wherein the second end of the cross member is pivotally connected to the second support member and wherein the first end of the cross member is removably connected to the first front surface of the first support member;

wherein the cross member includes a first bracket extending from the first end of the cross member and a second bracket extending from the second end of the cross member, wherein the first bracket and the second bracket each are comprised of an L-shaped bracket having a first segment and a second segment extending at an angle from the first segment;

wherein the first segment of the first bracket is connected to the first end of the cross member, wherein the second segment of the first bracket is pivotally and removably connected to the first front surface of the first support member by a first pin, wherein the second segment for the first bracket is parallel and adjacent to the first front surface of the first support member, and wherein the first pin has a first threaded end that is threadably connected to a threaded opening within the first bracket;

wherein the first segment of the second bracket is connected to the second end of the cross member, wherein the second segment of the second bracket is pivotally and removably connected to the second front surface of the second support member by a second pin, wherein the second segment for the second bracket is parallel and adjacent to the second front surface of the second support member, and wherein the second pin has a second threaded end that is threadably connected to a threaded opening within the second bracket;

wherein the cross member pivots about the first pin along a horizontal pivot axis, wherein the horizontal pivot axis is crosswise to a longitudinal axis of the cross member;

wherein the cross member is pivotable into a first position parallel and adjacent to the first front surface of the first support member when the second end of the cross member is disconnected from the second front surface of the second support member;

wherein the cross member is pivotable into a second position parallel and adjacent to the second front surface of the second support member when the first end of the cross member is disconnected from the first front surface of the second support member.

20. A method of positioning the exercise rack of claim 19 from the exercise position to the storage position, comprising:

removing the second end of the cross member from the second support member;

pivoting the cross member downwardly until the cross member is vertically orientated and parallel to the first front surface of the first support member; and positioning the first support member and the second support member into the storage position.

* * * * *